US006978107B2

(12) United States Patent
Nagashima et al.

(10) Patent No.: US 6,978,107 B2
(45) Date of Patent: Dec. 20, 2005

(54) DEVELOPER SUPPLY CONTAINER

(75) Inventors: Toshiaki Nagashima, Moriya (JP); Nobuo Nakajima, Kashiwa (JP); Kazuyoshi Sasae, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 10/461,464

(22) Filed: Jun. 16, 2003

(65) Prior Publication Data

US 2004/0047657 A1 Mar. 11, 2004

(30) Foreign Application Priority Data

Jun. 19, 2002 (JP) ..... 2002/178083

(51) Int. Cl.[7] ..... G03G 15/08

(52) U.S. Cl. ..... 399/262; 16/422; 16/425; 141/363; 141/366; 399/106; 399/113; 399/119; 399/120; 399/222

(58) Field of Search ..... 399/262, 119, 399/113, 222, 106, 120; 16/422, 425; 141/363, 366

(56) References Cited

U.S. PATENT DOCUMENTS

| | | | | |
|---|---|---|---|---|
| 4,931,838 A | | 6/1990 | Ban et al. | 355/260 |
| 5,491,542 A | | 2/1996 | Nagashima et al. | 355/260 |
| 5,778,282 A | | 7/1998 | Nagashima | 399/106 |
| 5,870,652 A | | 2/1999 | Kanamori et al. | 399/106 |
| 5,895,149 A | * | 4/1999 | Weed | 399/262 |
| 5,933,917 A | * | 8/1999 | Lo | 16/439 |
| 6,118,957 A | | 9/2000 | Fujiwara et al. | 399/103 |
| 6,118,958 A | | 9/2000 | Nagashima | 399/105 |
| 6,131,008 A | | 10/2000 | Kanamori et al. | 399/263 |
| 6,178,302 B1 | | 1/2001 | Nagashima et al. | 399/106 |
| 6,219,506 B1 | | 4/2001 | Morinaga et al. | 399/109 |
| 6,292,644 B1 | * | 9/2001 | Goto et al. | 399/262 |
| 6,501,924 B2 | | 12/2002 | Nagashima | 399/106 |
| 2002/0106214 A1 | | 8/2002 | Nagashima et al. | 399/106 |

FOREIGN PATENT DOCUMENTS

| | | |
|---|---|---|
| JP | 3-245170 | 10/1991 |
| JP | 7-199622 | 8/1995 |
| JP | 2907441 | 4/1999 |
| JP | 2000-172058 | 6/2000 |

* cited by examiner

*Primary Examiner*—Arthur T. Grimley
*Assistant Examiner*—Peter Lee
(74) *Attorney, Agent, or Firm*—Fitzpatrick, Cella, Harper & Scinto

(57) ABSTRACT

A developer supply container detachably mountable to a developer receiving device, includes a main body for accommodating a developer; a grip member for gripping the developer supply container; an engaging member for engagement with the grip member with said grip member being elastically deformed; and a regulating portion for regulating an elastic deformation of the grip member with the engaging member being mounted on the main body.

14 Claims, 15 Drawing Sheets

DEVELOPER SUPPLY CONTAINER

FIELD OF THE INVENTION AND RELATED ART

The present invention relates to a developer supply container used by an image forming apparatus, for example, a copying machine, a printer, a facsimile machine, etc., for forming images with the use of an electrostatic or electrophotographic method.

It has been a common practice to use powdery developer as a developing agent for an image forming apparatus, for example, a copying machine, a printer, facsimile machine, etc. Generally, a container used for supplying a developing apparatus with powdery developer is formed of synthetic resin or the like, and comprises: a container proper in the form of a cylinder, a rectangular parallelepiped, or the like; a developer outlet through which the powdery developer in the container proper is supplied to the developing apparatus of an image forming apparatus; and a sealing member for scaling the opening of the developer outlet. It has been also a common practice to make a process cartridge by integrating a developer supply container with a frame in which a photoconductive drum, a cleaner, a charging device, etc., are integrally disposed.

Some developer supply containers are provided with a handle usable for inserting the developer supply container into a developing apparatus, removing the developer supply container therefrom, rotating the developer supply container, and opening or closing a shutter for sealing the opening of the developer outlet of the container proper of the developer supply container. In other words, a handle is attached to a developer supply container for the purpose of facilitating a developer supplying operation, inclusive of an operation for replacing a developer supply container, carried out by a user. Japanese Laid-open Patent Application No. 2000-172058 discloses a developer supply container provided with a knob which is for rotating the developer supply container, and which is attached to one of the end portions of the developer supply container. This knob is supported by the container proper of the developer supply container, with the interposition of a shaft, and a part of the knob functions as a portion for controlling the rotation of the knob.

Japanese Patent No. 2907441 discloses a developer supply container comprising: a shutter movable to expose or cover the opening of the developer outlet of the container proper of the developer supply container; and a regulating member for regulating the shutter. More specifically, the shutter is structured so that its tip portion can be folded, and when the shutter is at the location at which it seals the opening, the regulating member keeps the tip portion of the shutter folded in order to cause the shutter to collide with the door of the main assembly, preventing thereby the door of the main assembly from being closed when the shutter is in the sealing position.

Japanese Laid-open Patent Application No. 3-245170 discloses several handles for a developer supply container, and Japanese Laid-open Patent Application No. 7-199622 discloses a developer-supply-container handle which covers the cap which covers the opening of the developer inlet of the container proper of a developer supply container.

In recent years, in order to improve image quality, the particle size of developer has been further reduced. Therefore, the developers currently available are more likely to scatter, and be more contaminative, compared to the developers used in the past. Also in recent years, the main-assembly size of image forming apparatuses, such as copying machines, printers, etc., has been reduced, and the number of desktop-type image forming apparatuses has been increasing. Therefore, it has become very important to come up with means for preventing contamination caused by developer during a developer supplying operation.

Thus, some image forming apparatuses are provided with an elastic seal or the like, which is disposed between a developer supply container and the developer inlet of the main assembly of an image forming apparatus, in order to better seal between the developer supply container and the developer inlet. The placement of an elastic seal or the like tends to increase the force necessary to insert a developer supply container into an image forming apparatus, or remove the developer supply container therefrom, as well as the force necessary to rotate the developer supply container. Normally, when a user carries out a developer-supplying operation, the user grasps the handle of a developer supply container in order to insert the developer supply container into an image forming apparatus, remove the developer supply container therefrom, or rotate the developer supply container. Sometimes, this handle of a developer supply container is formed as an integral part of the container proper of the developer supply container. However, forming the handle as an integral part of the container proper of the developer supply container reduces the number of the methods usable for molding the container proper, as well as the latitude in designing the container proper. Therefore, generally, a developer supply container handle is formed independently from the container proper of the developer supply container, and thereafter, it is attached to the container proper.

As the force necessary for carrying out a developer-supplying operation increases as described above, the amount of the stress to which the connective portions of the handle and container proper of a developer supply container are subjected also increases. Thus, unless the connective portions of the handle and container proper of a developer supply container are strong enough, the handle sometimes becomes disengaged from the container proper. Thus, it is a common practice to use a metallic substance as the material for the connective portions of the handle and/or container proper, or to form a handle by welding a plurality of components together, in order to obtain a handle and/or container proper strong enough to withstand the above-described increased stress. This tended to complicate the process of assembling a developer supply container, and also, increase the cost of a developer supply container.

Further, the attempt to make the handle of a developer supply container easier for a user to grasp to insert the developer supply container into the apparatus main assembly of an image forming apparatus, remove the developer supply container therefore, or rotate the developer supply container, tends to increase the handle size. Therefore, if a given image forming apparatus is structured so that a developer supply container with a larger handle can be used for supplying the image forming apparatus with developer, and so that the developer supply container must be kept within the main assembly of the image forming apparatus for the duration of the developer-supplying operation, the main assembly of the image forming apparatus had to be large enough to accommodate the developer supply container with a larger handle; in other words, the main assembly had to be larger by the amount by which the handle size was increased.

SUMMARY OF THE INVENTION

Accordingly, it is a principal object of the present invention to provide a developer supply container in which the mounting performance of a grip member is improved, and simultaneously, the grip member is effectively prevented from disengageing from an engaging member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS (Embodiment 1)

First, the first embodiment of the present invention will be described with reference to a copying machine as an image forming apparatus, more specifically, the main assembly of the copying machine.

{General Structure}

Figure 1:
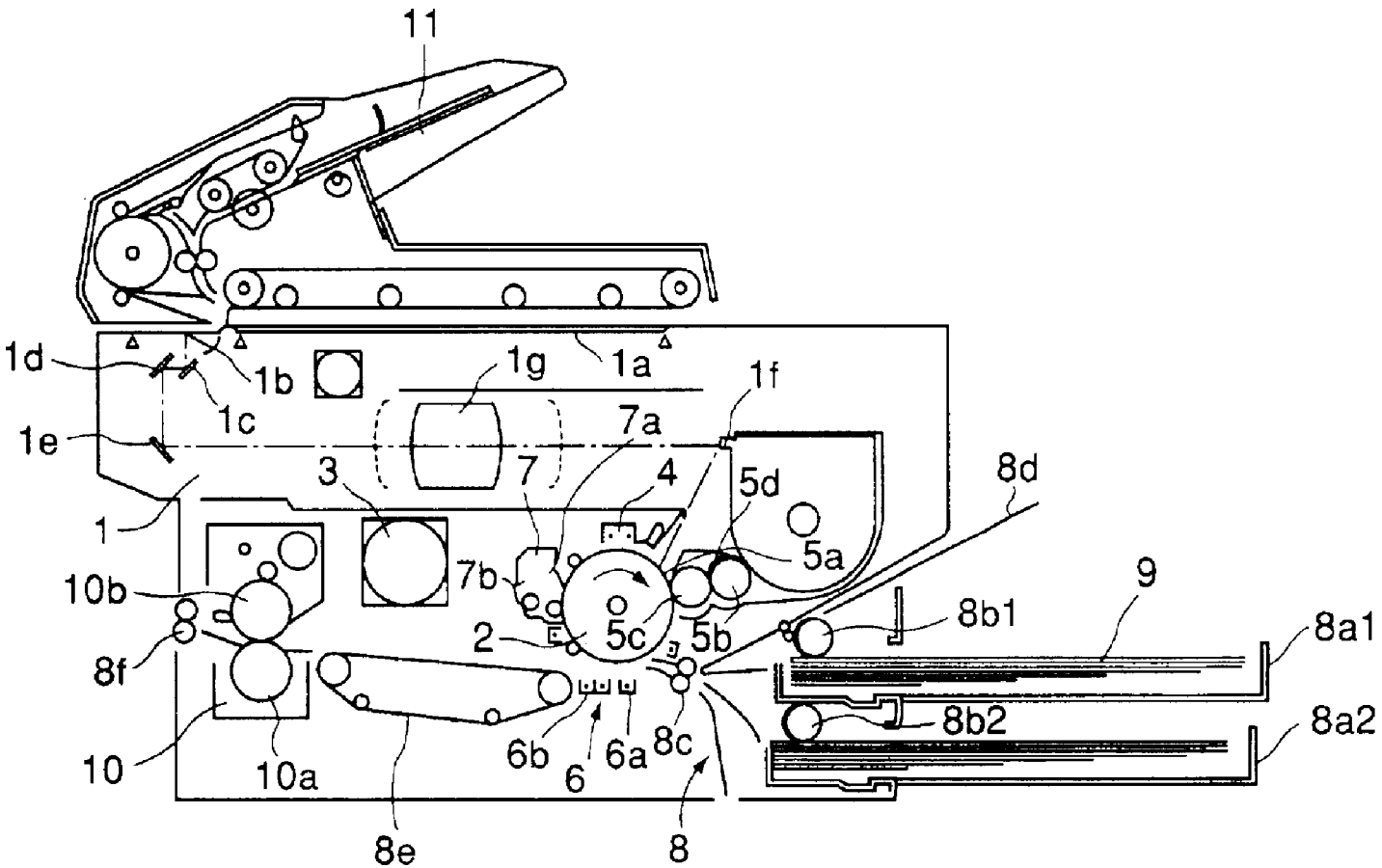
FIG. 1 is a sectional view of the copying machine in the first embodiment of the present invention, showing the general structure thereof.
Figure 2:
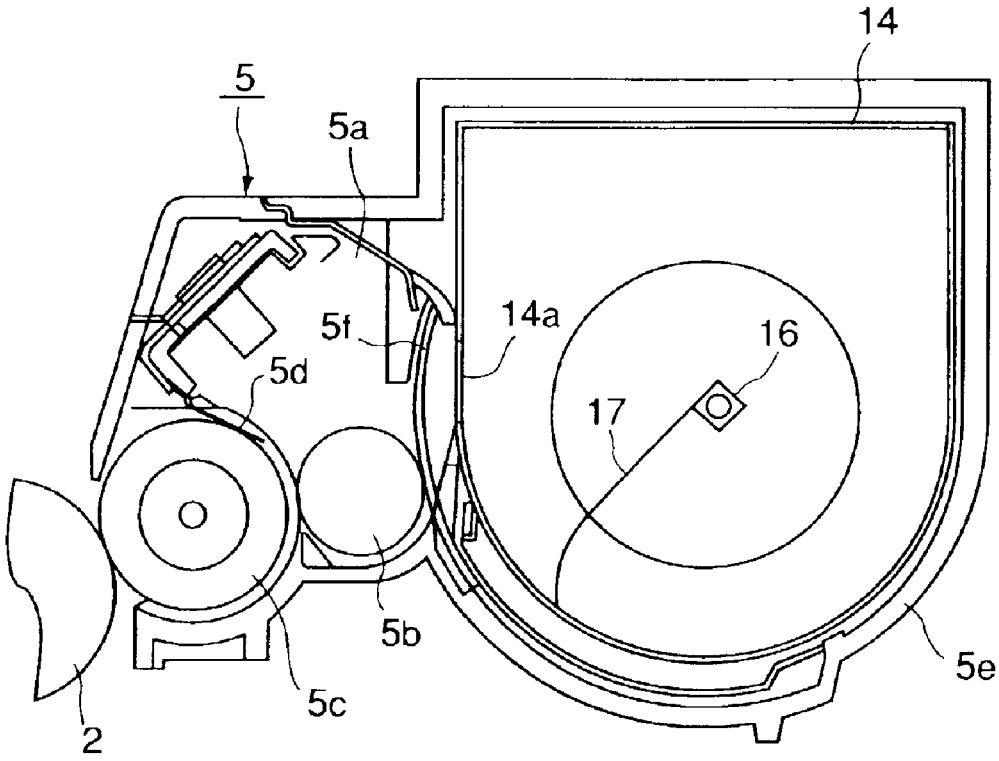
FIG. 2 is a sectional view of the developing apparatus in the first embodiment of the present invention, showing the structure thereof.

FIG. 1 is a drawing for showing the general structure of a typical copying machine, and FIG. 2 is a drawing for showing the general structure of a typical developing apparatus. Referring to FIG. 1, a reference number 1 designates an apparatus for reading an original, which comprises an original-placement glass platen 1*a,* an illumination lamp 1*b,* a scanning mirror 1*c,* deflection mirrors 1*d,* 1*e,* and 1*f,* and a lens 1*g,* etc. In operation, an original placed on the original-placement glass platen 1*a* is illuminated by the illumination lamp 1*b,* which is being moved together with the scanning mirror 1*c* in a manner to scan the original. The beam of light reflected by the original is deflected by the scanning mirror 1*c* and the deflective mirrors 1*d,* 1*e,* and 1*f,* and then, is focused on a photoconductive member or drum 2 as an image bearing member, through the lens 1*g,* which is capable of focusing, reducing, and magnifying light. As a result, an electrostatic latent image is formed on the photoconductive drum 2. The surface layer of the photoconductive drum 2 is formed of photosensitive substance. The photoconductive drum 2 is rotatable in the direction indicated by an arrow mark in the drawing, by a main motor 3 in synchronism with an image forming operation. The peripheral surface of the photoconductive drum 2 is surrounded by a charging apparatus 4, a developing apparatus 5, a transferring apparatus, and a cleaning apparatus.

While the photoconductive drum 2 is rotated, the peripheral surface of the photoconductive drum 2 is uniformly charged by the charging apparatus 4, and then, is exposed by the beam of light from the above-described original reading apparatus 1. As a result, an electrostatic latent image is formed on the peripheral surface of the photoconductive drum 2. This electrostatic latent image is developed by the developing apparatus 5 into an actual image formed of developer; and developer is transferred onto the electrostatic latent image. To describe the developing apparatus in more detail, the developing apparatus 5 comprises a developer chamber 5*a,* a developer moving member 5*b,* a development sleeve 5*c,* and a development blade 5*d.* Further, in the hollow of the development sleeve 5*c,* a magnet is stationarily disposed. In operation, the developer in the developer chamber 5*a* is sent to the development sleeve 5*c* by the developer moving member 5*b,* which is being rotated. As a result, the developer is borne on the development sleeve 5*c* as the development sleeve 5*c* is rotated. Then, the developer on the peripheral surface of the development sleeve 5*c* is leveled by the development blade 5*d* into a developer layer while being given triboelectric charge by the development blade 5*d.* A certain portion of the developer on the peripheral surface of the development sleeve 5*c* is transferred onto the photoconductive drum 2, in the pattern of the latent image on the photoconductive drum 2. As a result, a visible image is formed of the developer, on the photoconductive drum 2.

Incidentally, when the developer used for image formation is single-component developer, the developer is toner alone, whereas when the developer used for image formation is two-component developer, the developer is toner alone, or the combination of toner and a carrier. Thus, the developer supply container, which will be described later, is a container for supplying at least toner.

The developer image is transferred by the voltage applied by the transferring apparatus 6, onto a recording medium 9 being conveyed by the conveying apparatus 8. The transferring apparatus 6 comprises a transfer charging device 6*a* and a separation charging device 6*b.* As voltage opposite in polarity to the developer is applied by the transfer charging device 6*a,* the developer image is transferred onto the recording medium 9 being conveyed, whereas, as voltage is applied to the recording medium 9 by the separation charging device 6*b* after the transfer, the recording medium 9 is separated from the photoconductive drum 2.

The residual developer, that is, the developer remaining on the peripheral surface of the photoconductive drum 2 after the transfer of the developer image onto the recording medium 9, is removed by a cleaning apparatus 5, which recovers the residual developer into the recovered developer bin 7*b* by scraping down the residual developer, with the use of its developer cleaning blade 7*a.*

As for the conveying apparatus 8, it comprises top and bottom cassettes 8*a*1 and 8*a*2, which are disposed in the bottom portion of the apparatus main assembly, and which are capable of holding a plurality of recording media 9. The conveying apparatus 8 is structured so that the recording media 9 stored in the cassettes 8*a*1 and 8*a*2 can be supplied one by one to a pair of registration rollers 8*c* by a pickup roller 8*b*1 or 8*b*2. After being supplied from the cassette 8*a*1 or 8*a*2, or a manual feeding tray 8*d,* the recording medium 9 is further conveyed by the pair of registration rollers 8*c* which rotates in synchronism with the image forming operation on the photoconductive drum 2, and the development image is transferred onto the recording medium 9 at the position of the transferring apparatus 6.

After the developer-image transfer, the recording medium 9 is conveyed by a conveyance belt 8*e* to a fixing apparatus 10 comprising a driving roller 10*a,* and a heating-pressing roller 10*b* which contains a heater. In the fixing apparatus 10, the unfixed developer image on the recording medium 9 is fixed to the recording medium 9 through the application of heat and pressure. Thereafter, the recording medium 9 is discharged from the image forming apparatus by a pair of discharge rollers 8*f.*

As described above, the copying machine in this embodiment is fitted with an automatic original feeding apparatus, which is located above the original-placement glass platen 1*a,* and which makes it possible to automatically feed one by one a plurality of originals after separating them. The structure of this automatic original feeding apparatus 11, however, will not be described in detail, because it is well-known.

{Developer Supply Container}

Figure 3:
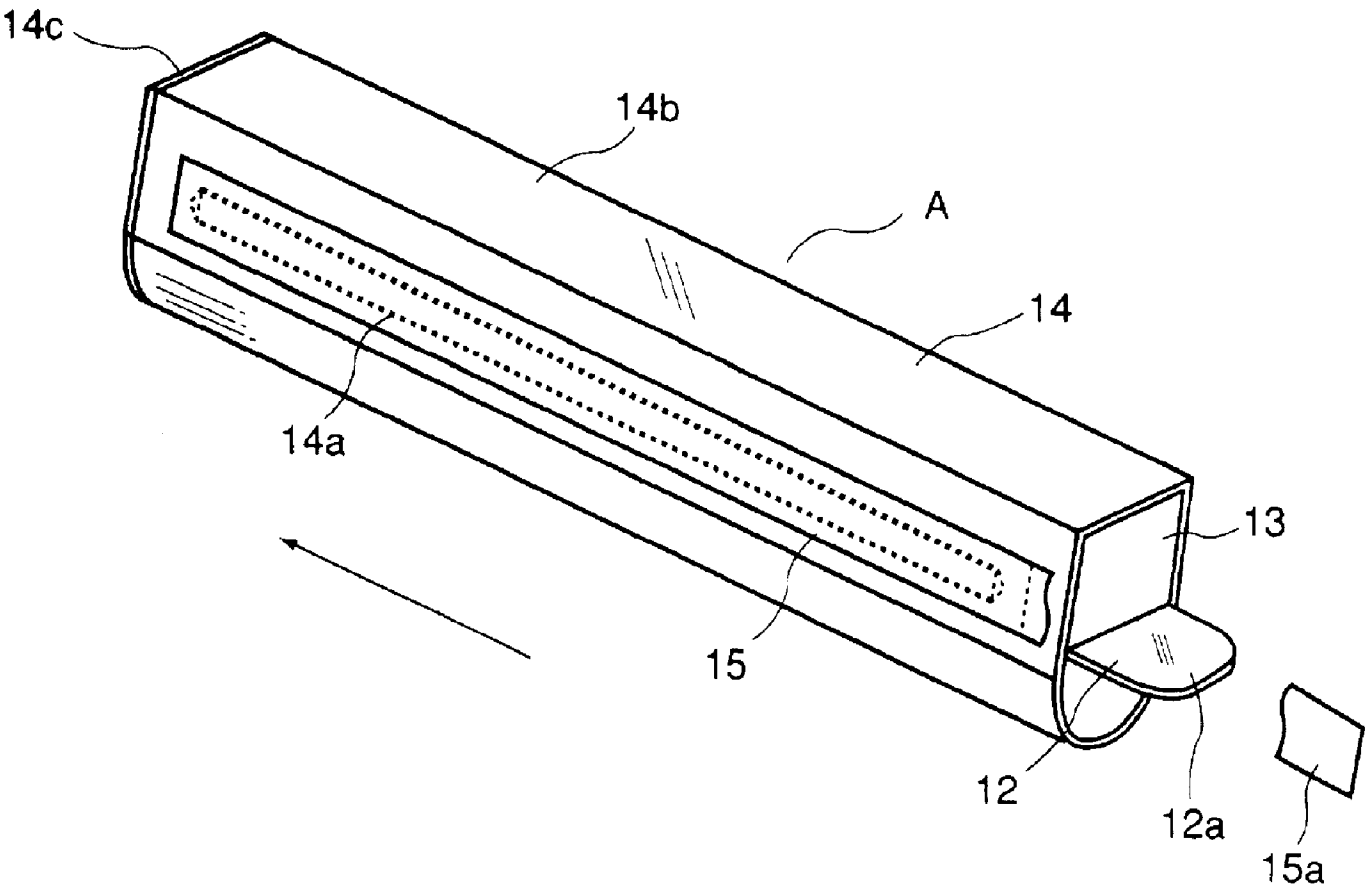
FIG. 3 is a perspective view of the developer supply container A in the first embodiment of the present invention, showing the structure thereof.

Next, the structure of the developer supply container A in this embodiment will be described with reference to FIGS. 3 and 4. FIG. 3 is a perspective view of the developer supply container A in this embodiment, showing the structure thereof, and FIG. 4 is a sectional view of the developer supply container A in this embodiment, showing also the structure thereof.

Figure 4:
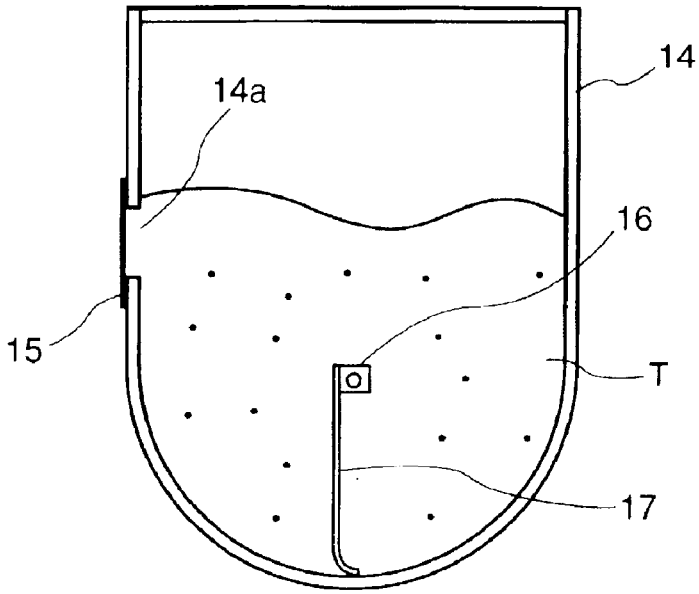
FIG. 4 is a sectional view of the developer supply container in the first embodiment of the present invention, showing the structure thereof.

As is evident from FIGS. 3 and 4, the developer supply container A in this embodiment comprises a handle 12, a handle mount 13, a container proper 14, a developer seal 15, a stirring member 16, and a stirring sheet 17. The developer seal 15 is for sealing the opening of the developer outlet 14*a* of the container proper 14. The stirring member 16 and stirring sheet 17 are for supplying the developer T in the container proper 14 to the developing apparatus while stirring the developer.

As for the mounting of the developer supply container A into the image-forming-apparatus main assembly (which hereinafter will be simply referred to as main assembly), first, the developer supply container A is to be held by the handle 12, so that the handle will be on the front side of the apparatus main assembly. Then, the developer supply container A is to be inserted into the developer-supply-container slot of the main assembly, in such a manner that the lengthwise direction (indicated by an arrow mark in FIG. 3) of the developer supply container A remains perpendicular to the front panel of the main assembly. Although, in this embodiment of the present invention, a copying machine is referred to as an image forming apparatus, the developer supply container in this embodiment is compatible with image forming apparatuses, inclusive of printers, other than a copying machine.

Further, a part of the above-described image formation engine may be disposed in a cartridge removably mountable in the main assembly of an image forming apparatus. For example, a process cartridge removably mountable in the image-forming-apparatus main assembly may be created by integrally disposing, in addition to the photoconductive drum 2 as an image bearing member, a minimum of one apparatus among the cleaning apparatus 7 as a cleaning means, the charging apparatus 4 as a charging means, and the developing apparatus 5 as a developing means, in a cartridge removably mountable in the image-forming-apparatus main assembly. In such a case, the developer supply container A is removably mounted into the process cartridge, and the developer is supplied into the process cartridge from the developer supply container A.

Next, the various components in the developer supply container A will be described. Referring to FIGS. 3 and 4, the container proper 14 in this embodiment is roughly in the form of a rectangular parallelepiped; the top portion is in the form of a rectangular parallelepiped, and the bottom portion is semicylindrical.

The container proper 14 is provided with a developer outlet 14*a* through which the developer is supplied from the developer supply container A into the developing apparatus 5 of the main assembly, through the developer inlet 5*f* (also called the developer receiving opening) of the developing apparatus 5, which is in alignment with the developer outlet 14*a*. The developer outlet 14*a* is a long and narrow hole, extending in the flat portion (top portion) of the container wall, parallel to the lengthwise direction of the container proper 14, and its width, in terms of the direction perpendicular to the lengthwise direction of the container proper 14 is 5 mm.

The container proper 14 must be strong enough to internally hold the developer and protect the developer until the developer is supplied to the developing apparatus 5. Thus, the container proper 14 in this embodiment is formed of polyethylene, and is give a wall thickness of 1 mm. According to an ordinary manufacturing method, the lateral wall 14*b* and end walls 14*c* of the container proper 14 are separately molded, and then, are joined during assembly. In this embodiment, however, the lateral wall 14*b* and one of the end walls, of the container proper 14 are injection molded in a single piece, and then, are joined with the other end wall 14*c*. The method in which the lateral wall 14*b* is separately molded from the end walls 14*c*, and then, is joined with the end walls 14*c*, is advantageous in consideration of ease of molding and assembly, as well as cost; such a method may be employed in place of the method used in this embodiment.

The developer seal 15 is for sealing the developer outlet 14*a*, and its primary requirement is to prevent the developer from leaking during shipment or due to changes in environmental factors, etc., before the development cartridge is put to use. On the other hand, the developer seal 15 must be easy for an operator to remove when supplying developer. Thus, it is common practice for the developer seal 15 to be welded with the use of heat welding, ultrasonic welding, or the like, or to be pasted with the use of two-sided adhesive tape, or the like. In this embodiment, the developer seal 15 is welded to the container proper 14 along the edge of the opening of the developer outlet 14*a*. The developer seal 15 is made substantially longer than the opening of the developer outlet 14*a*, being longer than twice the length of the opening of the developer outlet 14*a* so that the portion of the developer seal 15 remaining after being doubled back after sealing the opening of the developer outlet 14*a* from one lengthwise end to the other can be used to make a handle 15*a*, which can be used by a user to pull the development seal 15 to remove it from the container proper 14 to expose the opening of the developer outlet 14*a*. The developer seal 15 is given a laminar structure, comprising a polyester layer, a nylon layer, a polyethylene layer, and a sealant layer.

The stirring member 16 and stirring sheet 17 are disposed within the container proper 14. They receive a driving force from the apparatus main assembly, and convey the developer from the container proper 14 to the developing apparatus 5 through the developer outlet 14*a* while stirring the developer. More specifically, the stirring member 16 comprises: a coupler portion (which is unshown, but is on the 14*c* side, that is, opposite side of container proper 14, with respect to where handle 12 is attached), which engages with its counterpart on the apparatus-main-assembly side to receive the driving force; and a shaft portion, to which the stirring sheet 17 is fixed, and which rotates within the container proper 14. The stirring member 16 must be strong enough to rotate while supporting the stirring sheet 17, and further, must be lubricous enough to smoothly rotate while being supported by the container proper 14. Thus, polyacetal is used as the material for the stirring member 16.

The stirring sheet 17 is rotated in the container proper 14 to supply the developer in the container proper 14 to the developer outlet 14*a* while stirring and loosening the developer. It is formed of 100 m thick sheet of polyester.

The handle 12 is a portion of the developer supply container A, which a user grasps when the user mounts the developer supply container A into the apparatus main assembly, or pulls out the developer supply container A from the apparatus main assembly in order to replace the developer supply container A. It is disposed at one of the lengthwise ends of the container proper 14.

Figure 15:
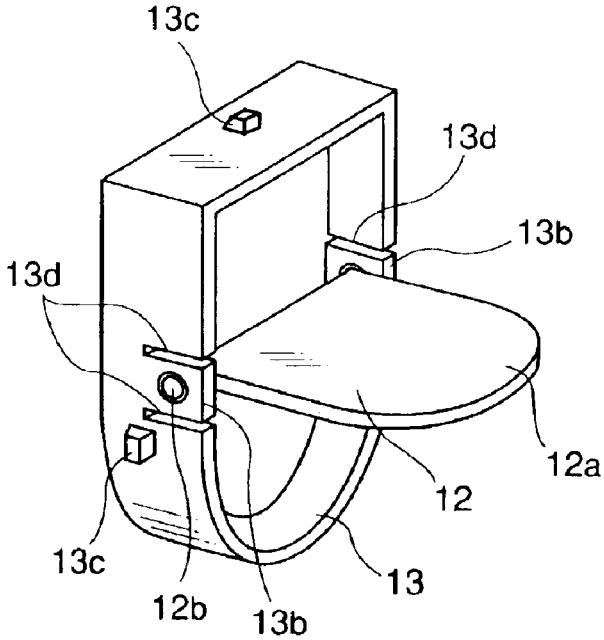
FIG. 15 is a perspective view of the handle unit in the third embodiment of the present invention, showing the structure thereof.

Referring to FIG. 3, the handle 12 comprises a grip portion 12*a*, that is, a portion of the handle 12 which a user actually grasps, making it easier for the user to grasp the handle, in order to handle the developer supply container A. The handle 12 in this embodiment is structured so that it is attached to the handle mount 13, which is attached to the container proper 14. Further, the handle 12 is provided with a pair of shafts 12*b* by which the handle 12 is attached to the handle mount 13 (FIG. 15). The handle 12 must be easy to grasp, and also, strong enough to withstand a certain amount of stress resulting from the handling of the developer supply container A by a user. On the other hand, the handle 12 must be elastic enough to be temporarily deformable so that the pair of shafts 12*b* thereof can be snapped into a pair of recesses 13*b* of the handle mount 13. Thus, polystyrene, ABS, polypropylene, polyethylene, and the like, can be considered as the material for the handle 12. In this embodiment, polypropylene is used as the material for the handle 12.

The handle mount 13 must be capable of reliably supporting the handle 12 snap fitted therewith, and easily and firmly attachable to the container proper 14. Further, it must be strong enough to firmly support the handle 12, and prevent the handle 12 from being disengaged from the handle mount 13 by external forces, for example, tension, compression, torsion, etc., which occur as a user handles the developer supply container A by grasping the handle 12. In other words, the handle mount 13 must be stiffer than the handle 12. Thus, polystyrene, ABS resin, polycarbonate, etc., can be considered as the material for the handle mount 13. In this embodiment, ABS resin is used as the material for the handle mount 13.

Referring to FIG. 3, in this embodiment, the handle 12 is engaged with the handle mount 13, and then, the handle mount 13 is attached to the container proper 14. It is possible to mold the handle 12 as an integral part of the container proper 14, or as an integral part of the handle mount 13, as it is in some of the conventional developer supply containers. However, such arrangements make the combination of the two components too complicated in shape, affording thereby less latitude in container design, making the combination difficult to mold, or resulting in a cost increase traceable to mold tack-down.

This embodiment is not intended to limit the choices of the materials and shapes of the various components of the developer supply container A to those in this embodiment; any substance may be employed as the material for the developer supply container A, as long as the substance makes it possible to embody the present invention.

{Assembly of Developer Supply Container}

Next, how to assemble the developer supply container A in this embodiment will be described.

First, the developer seal 15 is heat welded to the container proper 14 to seal the opening of the developer outlet 14*a*, and the handle portion 15*a* of the developer seal 15 is folded back by 180.

Then, the end wall 14*c* is attached to the lateral wall portion 14*b* of the container proper 14. Then, the stirring member 16, to which the stirring sheet 17 has been fixed, is disposed within the container proper 14. Then, the container proper 14 is filled with developer, and then, the developer inlet (unshown) of the container proper 14 is sealed with an inlet cap (unshown). The above-described assembly sequence may be altered depending on the structure of a developer supply container; it does not need to be strictly followed.

Lastly, the handle unit, or the combination of the handle 12 and the handle mount 13, is attached to the container proper 14.

{Assembly of Handle Unit}

Figure 5:
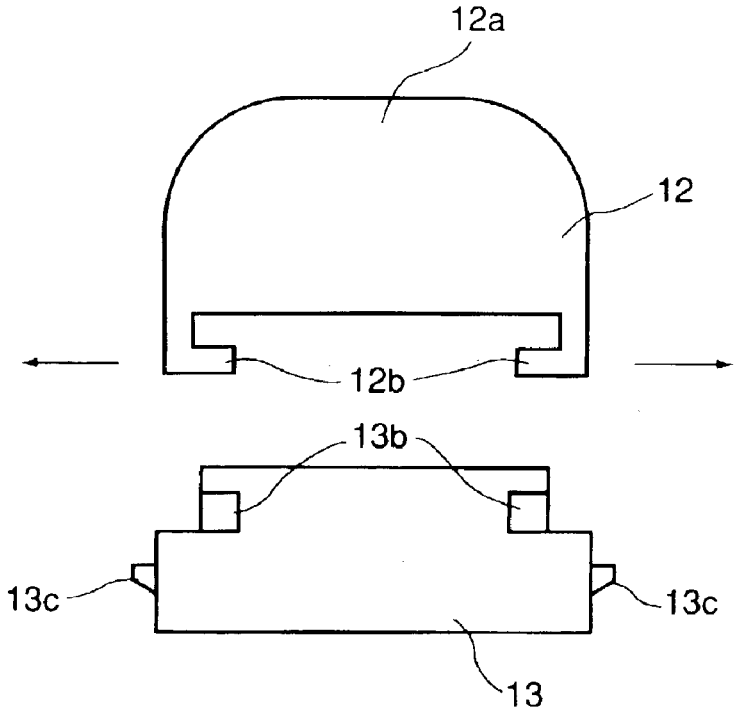
FIG. 5 is a sectional view of the handle and handle mount in the first embodiment of the present invention, showing the structures thereof.
Figure 6:
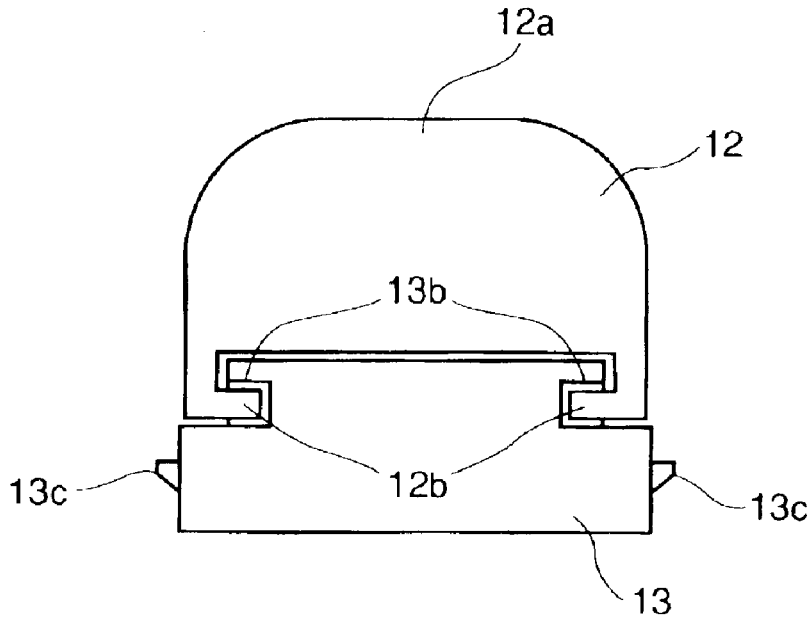
FIG. 6 is a sectional view of the handle unit in the first embodiment of the present invention, showing how the handle unit is assembled.
Figure 7:
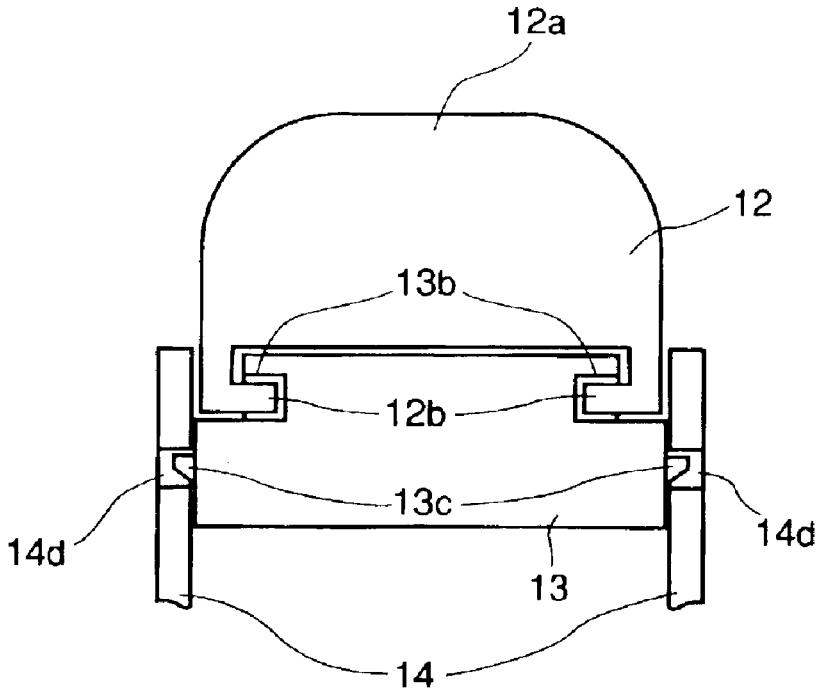
FIG. 7 is a sectional view of the handle portion of the developer supply container A in the first embodiment of the present invention.

Next, how to assemble the handle unit will be described. FIGS. 5 to 7 show the method for assembling the handle unit. The handle 12 in this embodiment comprises: the grip portion 12*a,* which is actually grasped by a user; and the pair of connective portions 12*b* by which the handle 12 is anchored to the handle mount 13. Referring to FIG. 5, the grip portion 12*a* is shaped so as to be easily graspable by a user. The connective portions 12*b* are in the form of a shaft which is square in cross section. Therefore, the holes of a pair of connective portions 13*b* of the handle mount 13 are made square in cross section. When placing the connective portions 12*b* of the handle 12 in the holes of the connective portions 13*b* of the handle mount 13, the connective portions 12*b* are temporarily bent so as to widen the gap between the two connective portions 12*b* (in the direction indicated by arrow mark in FIG. 5), and the connective portions 12*b,* in the form of a shaft, are fitted in the holes of the connective portions 13*b* of the handle mount 13 (FIG. 6).

Then, this combination of the handle 12 and the handle mount 13, that is, the handle unit, is attached to the container proper 14 by the handle mount 13. As for the method for attaching the handle mount 13 to the container proper 14, welding, gluing, or the like method may be used. In this embodiment, however, the handle mount 13 is provided with a pair of projections 13*c,* and the handle mount 13 is attached to the container proper 14 by fitting the pair of projections 13*c* in a pair of hole 14*d* of the container proper 14, one for one, as shown in FIG. 7, for the sake of simplicity, reliability, and low cost.

These holes 14*d* may be replaced with a pair of recesses, as long as the handle mount 13 does not easily disengage from the container proper 14 after its attachment to the container proper 14.

Figure 8:
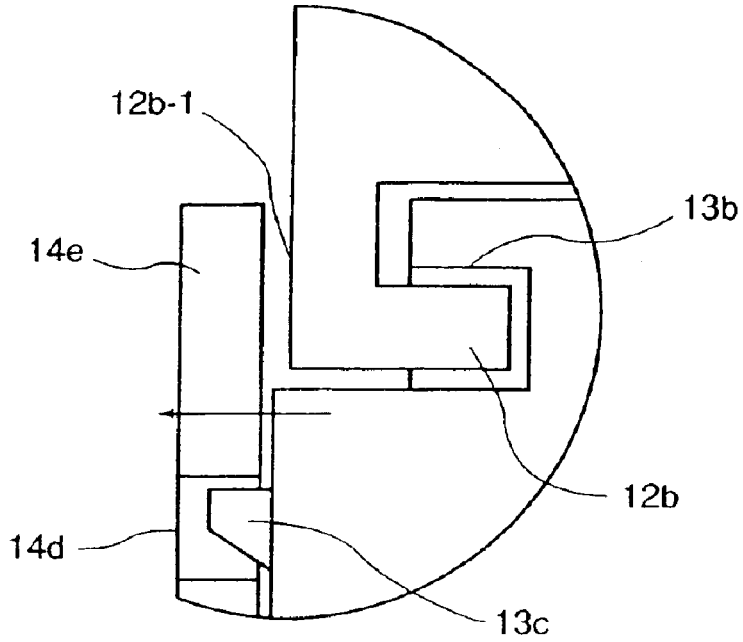
FIG. 8 is an enlarged sectional view of the handle portion of the developer supply container A in the first embodiment of the present invention.

Referring to FIG. 8, which is an enlarged sectional view of the connective portions of the handle 13, as the pair of projections 13*c* of the handle 13 are fitted in the pair of holes 14*d* of the container proper 14, one for one, each connective portion 12*b* of the handle 12 is sandwiched by the handle mount 13 and container proper 14. Therefore, even if the grip portion 12*a* of the handle 12 is subjected to a substantial amount of force when a user is mounting or dismounting the developer supply container A by grasping the grip portion 12*a* of the handle 12, the handle 12 does not come off. To describe this structure in more detail, in this embodiment, each connective portion 12*b* of the handle 12, which has temporarily deformed during the fitting of the connective portion 12*b* in one of the connective holes 13*b* of the handle mount 13, is supported by the handle mount 13 and container proper 14, being thereby prevented by a part 14*e,* as a regulating portion, of the wall of the container proper 14, from deforming in the direction indicated by an arrow mark in FIG. 8 to slip out of the connective hole 13*b* of the handle mount 13. Therefore, even if the handle 12 is pulled with a substantial amount of force, the handle 12 does not disengage from the handle mount 13.

For the above-described reason, the handle mount 13 needs to be harder and stiffer than the handle 12; the handle mount 13 is required at least not to easily deform in such a manner as to allow the handle 12 to disengage from the handle mount 13 when the handle 12 is pulled. On the contrary, the handle 12 is required to be elastic to some degree so that it can be temporarily deformed when anchoring the handle 12 to the handle mount 13, and yet stiff enough to prevent the accident that after the anchoring of the handle 12 to the handle mount 13, that is, after the sandwiching of the connective portions 12*b* of the handle 12 between the handle mount 13 and container proper 14, the handle 12 disengages from the handle mount 13 even if the handle 13 and container proper 14 do not deform.

As long as the above described requirements are satisfied, the materials and shapes of the handle 12 and handle mount 13 may be freely chosen. Obviously, the shapes of the connective portions of the handle 12 and the handle mount 13 do not need to be limited to those in this embodiment. For example, the handle 12 may be provided with a pair of connective holes while the handle mount 13 is provided with a pair of connective shafts. The holes may be through holes or blind holes. Further, both the connective portion 12*b* of the handle 12 and the connective portion 13*b* of the handle mount 13 may be in the form of a hook. Moreover, the cross sections of the shafts and holes may be in a polygonal shape other than square.

The handle 12 and handle mount 13 in this embodiment are structured so that they can be attached without welding or gluing; they can be simply attached by being fitting with each other. Therefore, they are easily to assemble, are low in cost, and yet, assure that the handle does not come off.

Further, in this embodiment, the container proper 14 has an internal volume of 600 cc, and is filled with 300 g of developer.

{Developer Supplying Operation}

Figure 9A:
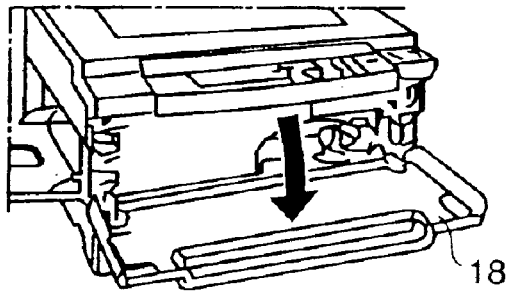
FIGS. 9(A) and 9(B) are perspective drawings of the developer supply container A, and the main assembly of an image forming apparatus, in the first embodiment of the present invention, showing the steps followed to mount the former into the latter.
Figure 9B:
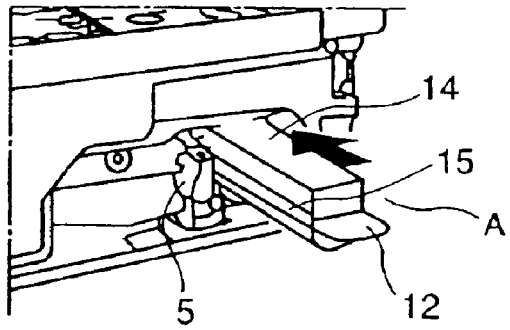

Next, referring to FIGS. 9(A) and (B), the method for supplying developer with the use of the developer supply container A in this embodiment will be described. In this embodiment, the developer supply container A is held by a user by the handle 12 of the developer supply container A, and is inserted into the developing apparatus 5 in the direction parallel to the lengthwise direction of the developer supply container A. The main assembly of an image forming apparatus is provided with a hinged cover 18, which is opened or closed when replacing the developer supply container A. Thus, first, the hinged cover 18 is opened, and then, the developer supply container A is inserted, so that the developer outlet 14*a* of the developer supply container A aligns with the developer inlet 15*f* of the developing apparatus 5.

Next, the operator is to grasp the handle portion 15*a* of the developer seal 15, and pull it to unseal the developer supply container A. Then, the user is to close the hinged cover 18 to complete the developer supplying operation.

Thereafter, the stirring member 16 receives driving force from the apparatus main assembly, being thereby rotated. As a result, the developer in the container proper 14 is conveyed to the developing apparatus 5 by the stirring sheet 17.

After the depletion of the developer in the container proper 14, that is, after the completion of the developer-supplying operation, the operator is to open the hinged cover 18 of the apparatus main assembly, grasp the handle 12, and pull handle 12 to remove the developer supply container A from the apparatus main assembly, in the direction opposite to the direction in which the developer supply container A is inserted into the apparatus main assembly. Then, the operator is to insert a new developer supply container A into the apparatus main assembly. The handle 12 of the developer supply container A in this embodiment did not disengage even when the developer supply container A was pulled hard, or twisted to some degree. Therefore, the developer supply container A in this embodiment could be smoothly mounted or dismounted.

When developer was supplied using the developer supply container A in this embodiment, the force necessary to remove the developer seal 15 was 20–30 N, allowing the developer seal 15 to be easily removed, and therefore, the developer supplying operation could be smoothly carried out.

Further, 100 developer supply containers were manufactured, and were subjected to shipment tests and environmental tests. As a result, no anomalies were found.

(Embodiment 2)

Next, the developer supply container in the second embodiment of the present invention will be described. The developer supply container in the second embodiment is basically the same as that in the first embodiment, except that in the second embodiment, in order to anchor the handle 12 to the handle mount 13, the handle mount 13 is temporarily deformed, instead of deforming the handle 12 as in the first embodiment.

Figure 10:
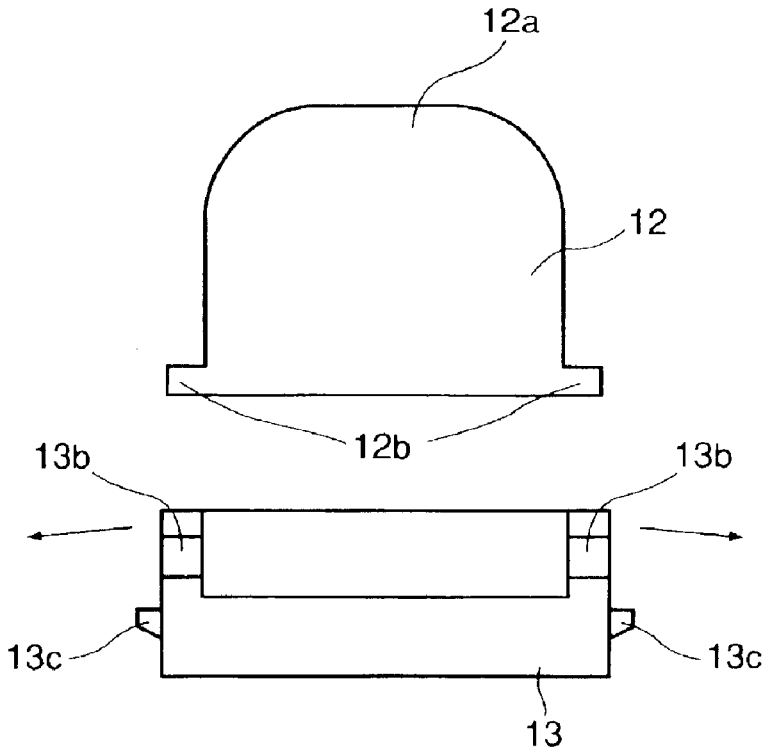
FIG. 10 is a sectional view of the handle and handle mount in the second embodiment of the present invention, showing the structures thereof.
Figure 11:
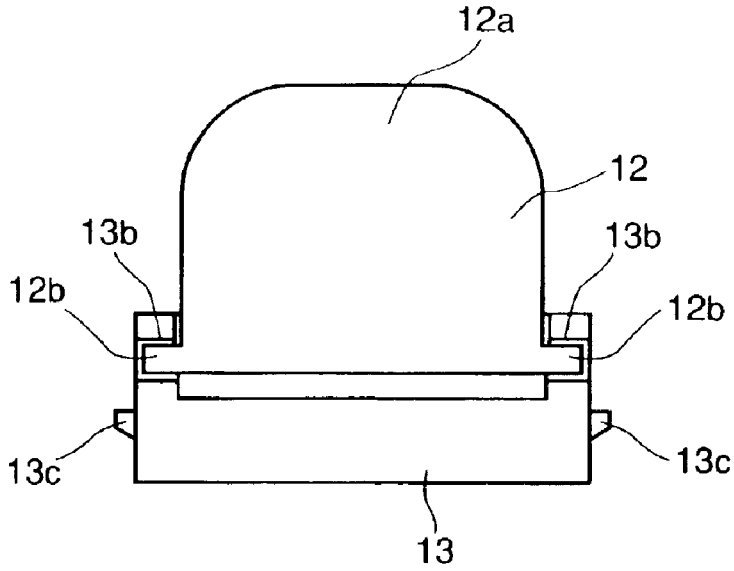
FIG. 11 is a sectional view of the handle unit in the second embodiment of the present invention, showing how the handle unit is assembled.
Figure 12:
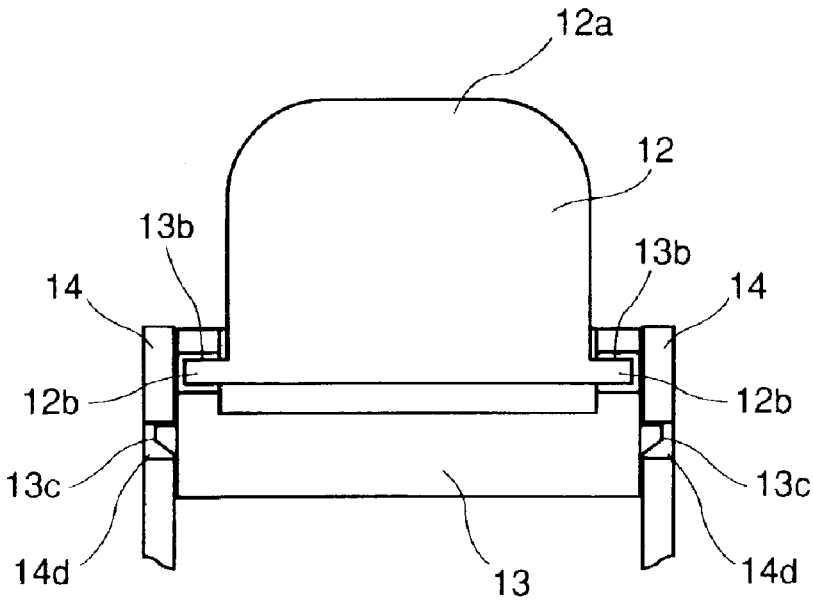
FIG. 12 is a sectional view of the handle portion of the developer supply container A in the second embodiment of the present invention.

Referring to FIGS. 10 to 12, the method for assembling the handle unit in this embodiment will be described. First, referring to FIG. 10, in this embodiment, the handle unit is structured so that the shaft portions of the connective portions 12*b* of the handle 12 point outward. Thus, the handle 12 is anchored to the handle mount 13 by temporarily deforming outward (direction indicated by an arrow mark in FIG. 10) the pair of connective portions 13*b* of the handle mount 13.

FIG. 11 is a sectional view of the handle unit alone, and FIG. 12 is a sectional view of the handle unit and its adjacencies after the attachment of the handle unit to the container proper 14. As for the attachment of the handle unit to the container proper 14, the handle unit is attached in the same manner as it is in the first embodiment. In other words, the pair of projections of the handle mount 13 are fitted, one for one, into the pair of the handle unit anchoring holes 14*d* of the container proper 14.

In this embodiment, the positional relationship between each of the connective portions of the handle 12 and corresponding connective portion of the handle mount 13, relative to the container proper 14, is opposite to that in the first embodiment. In other words, the connective portion 13*b* of the handle mount 13 is sandwiched between the connective portion 12*b* of the handle 12 and the container proper 14. Thus, unlike in the first embodiment, it is unnecessary to deform the handle 12 in order to attach the handle to the handle mount 13. Therefore, a substance more rigid than the one used as the material for the handle 12 in the first embodiment can be selected as the material for the handle 12, and also, a shape which makes the handle 12 more rigid than the one used for the handle 12 in the first embodiment can be selected as the shape for the handle 12. With the use of such material and shape, the handle 12 in this embodiment is less likely to deform when the developer supply container A is handled by the handle 12 by a user. In other words, this structural arrangement is preferable to the one in the first embodiment.

Figure 13:
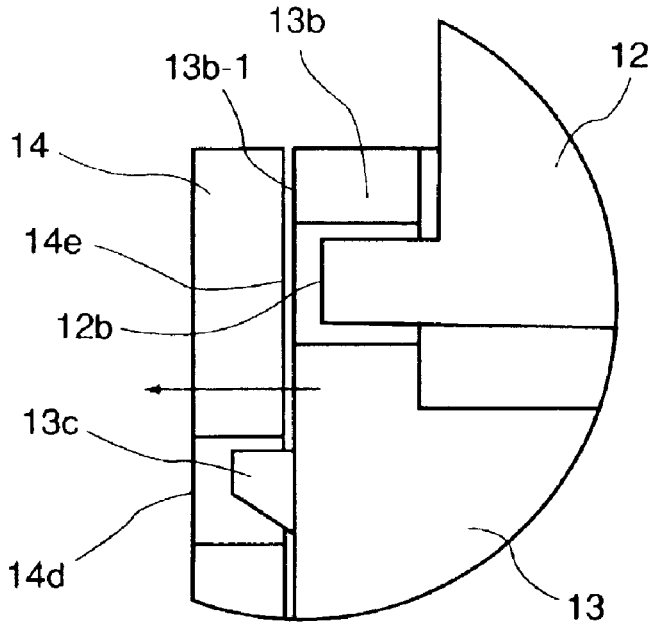
FIG. 13 is an enlarged sectional view of the handle portion of the developer supply container A in the second embodiment of the present invention.

In this embodiment, when the handle 12 is pulled, it barely deforms. Further, the deformation of the connective portions 13*b* (13*b*-1 in FIG. 13) in the direction (indicated by arrow mark in FIG. 13) to allow the connective portions 12*b* of the handle 12 to disengage from the handle mount 13 is regulated by the portions 14*c*, as regulating portions, of the wall of the container proper 14. Therefore, the handle 12 is prevented from disengaging from the handle mount 13. Therefore, in this embodiment, the relationship between the handle 12 and handle mount 13 in terms of the hardness in material and stiffness in structure needs to be opposite to that in the first embodiment; the handle 12 needs to be harder in material and stiffer in structure than the handle mount 13.

Thus, the handle mount 13 is elastic enough to be temporarily deformed to allow the handle 12 to be attached to the handle mount 13, and yet, it must be stiff enough to prevent the handle mount 13 between the handle 12 and container proper 14 from disengaging from the handle 12 as long as the handle 12 and container proper 14 do not deform, after the anchoring of the handle unit to the container proper 14. As long as the above-described requirements are satisfied, the materials and shapes of the handle 12 and handle mount 13 may be freely chosen.

Figure 14:
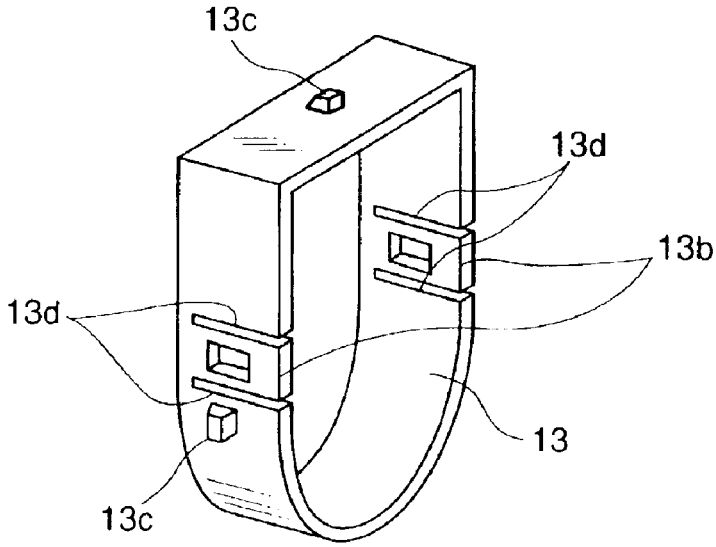
FIG. 14 is a perspective view of one of the modifications of the handle mount in the second embodiment of the present invention, showing the structure thereof.

This embodiment may be modified, as shown in FIG. 14, in order to improve the developer supply container A in terms of assembly efficiency. More specifically, the handle mount 13 may be provided with two pairs of slits 13*d*, which are positioned in such a manner that the two slits 13*d* of each pair sandwich a hole of the corresponding connective portion 13*b* of the handle mount 13. With provision of such a structural arrangement, the connective portion 13*b* of the handle mount 13 more easily deforms outward (direction indicated by arrow mark in FIG. 10), making it easier to attach the handle 12 to the handle mount 13. After the anchoring of the handle unit (handle mount 13) to the container proper 14, the deformation of this modified version of the connective portions 13*b* in the second embodiment is regulated by the container proper 14 as are the connective portions 13*b* of the original handle mount 13 in the second embodiment. Therefore, the same effects as those obtained by the second embodiment can be obtained by this modification. In other words, this modification of the second embodiment is preferable to the first embodiment.

The modification of the second embodiment makes it possible to locally reduce the rigidity of the connective portions 13*b* of the handle mount 13 by the providing the connective portions 13*b* with two pairs of slits 13*d*, making it thereby possible to use, as the material for the handle mount 13, a substance harder and stiffer than the substance used as the material for the handle mount 13 in the original second embodiment. The widths, lengths, shapes, etc., of the slits 13*d* may be freely chosen as long as the above described effects can be accomplished.

When developer was supplied using the developer supply container A in this embodiment, the developer supplying operation could be carried out as easily, smoothly, and reliably as when the developer supply container A in the first embodiment was used. In addition, the handle 12 in this embodiment, which is stiffer than that in the first embodiment, was easier to grasp, and also, easier to operate.

(Embodiment 3)

Next, the developer supply container in the third embodiment of the present invention will be described. This embodiment is compatible, in terms of structural arrangement, with the first embodiment as well as the second embodiment. Here, however, the structure compatible with the second embodiment will be described.

Figure 16:
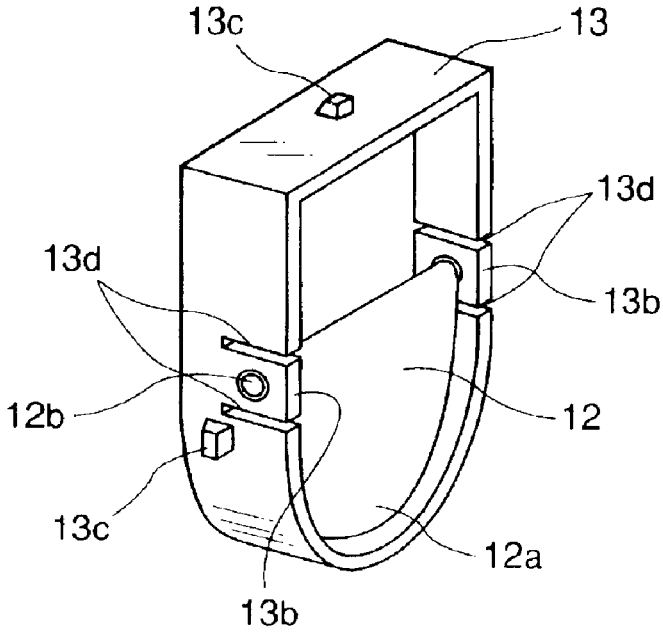
FIG. 16 is a perspective view of the handle in the third embodiment of the present invention, in the laid down position.

FIG. 15 is an enlarged perspective view of the handle unit in this embodiment, and FIG. 16 is a perspective view of the handle 12, in the third embodiment of the present invention, in its laid down position in the handle mount 13. The developer supply container A in this embodiment is virtually the same in structure as those in the first and second embodiments, except that in this embodiment, the connective portions 12*b*, in the form of a shaft, of the handle 12, are given a circular cross section, and the holes of the connective portions 13*b* of the handle mount 13, in which the connective portions 12*b* are fitted, are also given a circular cross section, so that after the attachment of the handle 12 to the handle mount 13, the handle 12 can be moved relative to the handle mount 13, more specifically, rotated about the axial lines of the connective portions 12*b*.

In addition, the developer supply container A in this embodiment is structured so that after the anchoring of the handle unit to the container proper 14, the handle 12 can be rotationally laid into the container proper 14 or the space surrounded by the handle mount 13, in such a manner that no part of the handle 12 protrudes beyond the external contour of the container proper 14 or handle mount 13.

Referring to FIG. 16, the grip portion 12*a* of the handle 12 is rotationally laid into the internal space of the handle mount 13. Therefore, the shape of the grip portion 12*a* is matched to that of the handle mount 13; it is semicircular. Otherwise, the shapes of the connective portions of the handle 12 and handle mount 13, the method for assembling them, etc., are the same as those in the second embodiment.

Figure 17:
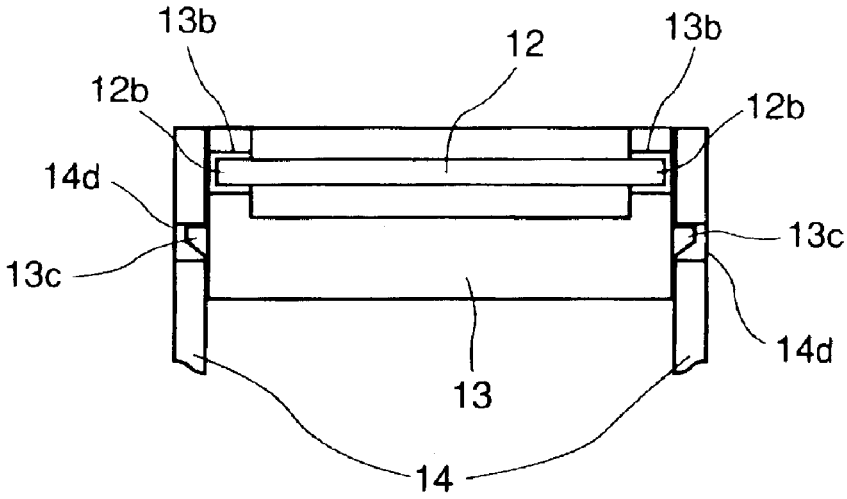
FIG. 17 is an enlarged sectional view of the handle portion of the developer supply container A in the third embodiment of the present invention.

FIG. 17, which is a sectional view of the connective portions of handle unit and the corresponding connective portions of the container proper 14, after the anchoring of the handle unit to the container proper 14, shows that the handle 12 is on the inward side of the handle mount 13 and container proper 14. This means that the handle 12 does not protrude outward beyond the external contour of the developer supply container A in this embodiment. In other words, this means that, in the case of the structural arrangement in which the external contour of the developer supply container A is formed by the handle mount 13, the handle 12 does not protrude outward beyond the external contour of the handle mount 13, whereas in the case of the structural arrangement in which the external contour of the developer supply container A is formed by the container proper 14, the handle 12 does not protrude beyond the contour of the container proper 14.

Next, the developer supplying operation carried out using the developer supply container A in this embodiment will be described.

First, a user is to remove the developer supply container A from the box, in which the developer supply container A has been held, and to raise the handle 12 toward the front side by grasping the handle 12 in the recess of the developer supply container A (as shown in FIG. 15). Then, the user is to mount the developer supply container A into the main assembly of an image forming apparatus after opening the hinged cover 18 of the main assembly. Then, the handle 12 is to be laid back into the recess of the developer supply container A, in which the handle 12 was. In other words, the developer-supplying operation carried out using the developer supply container A in this embodiment is the same as those carried out using the developer supply container A in the first or second embodiments, except that the handle 12 is returned to the above-described recess. In order to replace the developer supply container A in the apparatus main assembly, first, the user is to open the hinged cover 18 of the apparatus main assembly, and to raise the handle 12 toward the front side by grasping the handle 12 as the user is to do when mounting the developer supply container A into the apparatus main assembly. Then, the user is to pull out the developer supply container A from the apparatus main assembly.

If such a structural arrangement can be made that the handle 12 is raised or laid down by the opening or closing movement, respectively, of the hinged cover 18 of the apparatus main assembly, the operational efficiency can be further improved.

To describe this process more concretely, after a user mounts the developer supply container A into the apparatus main assembly by grasping the handle 12, the user must lay the handle 12 into the recess of the developer supply container A. If such a structural arrangement (unshown) is made that as the hinged cover 18 of the apparatus main assembly is closed, a part of the hinged cover 18 guides the handle 12 into the recess of the developer supply container A, the user does not need to manually lay the handle 12 into the recess of the developer supply container A. Therefore, not only does the developer-supplying operation become easier for the user, but also the problem that a user may forget to lay down the handle 12 into the recess of the developer supply container A is eliminated.

On the other hand, if such a structural arrangement (unshown) is made that when replacing the developer supply container A, the initial opening movement of the hinged cover 18 of the apparatus main assembly causes a part of the hinged cover 18 to engage with the handle 12, and then, the further opening movement of the hinged cover 18 causes the handle to become erect, all that has to be done by a user to remove the developer supply container A is to pull the developer supply container A by grasping the erect handle 12, eliminating the need for the user to make the handle erect. Therefore, the developer supplying operation becomes simpler.

As for a concrete example of the above described structural arrangements, it is possible to provide the hinged cover 18 with such a projection that pushes the handle 12 into the recess of the developer supply container A as the hinged cover 18 is closed, and that hooks the handles 12 as the hinged cover 18 is opened, or to provide the hinged cover 18 with a pushing projection provided with a fastening means, such as a piece of two-sided adhesive tape, so that as the hinged cover 18 is closed, the handle 12 is pushed into the recess of the developer supply container A by the projection, whereas as the hinged cover 18 is opened, the handle 12 is pulled into the erect position. In other words, any structural arrangement is acceptable as long as the handle 12 is movable by the movement of the hinged cover 18 in the above-described fashion; the structural arrangement for moving the handle 12 by the movement of the hinged cover 18 in the above described fashion does not need to be limited to that in this embodiment.

According to this embodiment, the handle 12 is made to rotationally lay down into the recess of the developer supply container A in such a manner that when the handle 12 is in its laid down position, no part of the handle 12 protrudes beyond the external contour of the developer supply container A, making it thereby possible to reduce the size of the main assembly of an image forming apparatus, and the size of the developer supply container A. More specifically, when a developer supply container is used to supply a developing apparatus with developer, the developer supply container is normally left in the apparatus main assembly. Thus, the developer-supply-container slot of the main assembly of an image forming apparatus, which employs a developer supply container provided with such a handle 12 as the handle 12 of most of the conventional developer supply containers that is formed perpendicular to the wall of the developer supply container in order to make it easier for a user to grasp the handle, needs to be increased in size to accommodate the handle 12.

Figure 18:
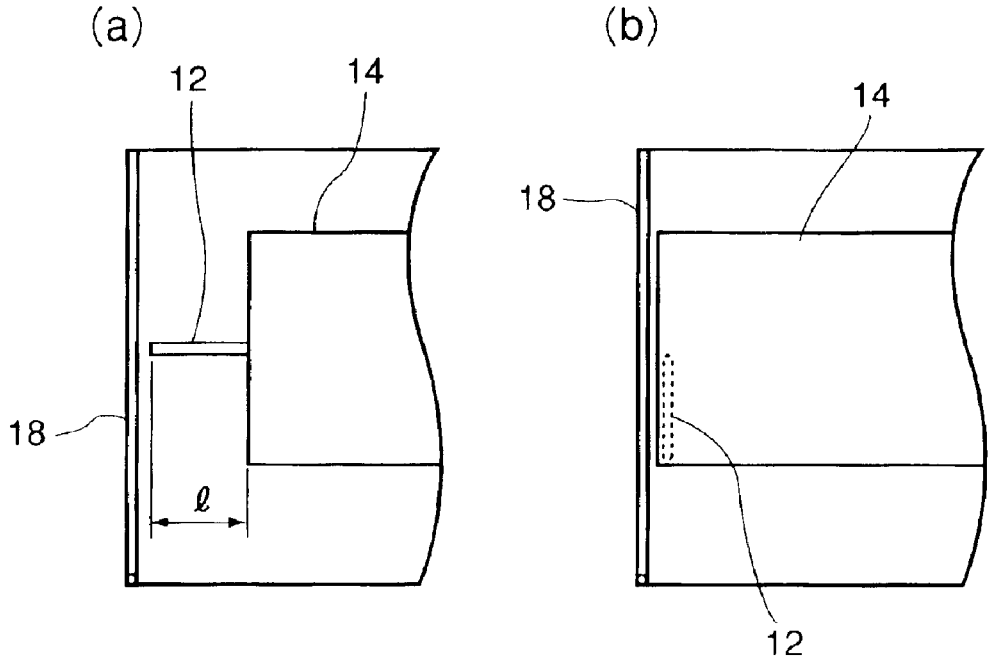
FIG. 18(A) is a sectional view of the handle portion of a conventional developer supply container in the main assembly of an image forming apparatus.
FIG. 18(B) is a sectional view of the handle portion of the developer supply container A in the third embodiment of the present invention, in the main assembly of an image forming apparatus.

In comparison, the handle 12 of the developer supply container A in this embodiment can be laid down into the recess of the developer supply container A as shown in FIG. 18(B), making it possible to reduce the length of the developer supply container A. In other words, the employment of the developer supply container A in this embodiment makes it possible to reduce the length of the developer-supply-container slot of the apparatus main assembly by a length of compared to that of a developer supply container provided with a conventional handle 12 shown in FIG. 18(A), that is, a handle which cannot be laid down.

Further, providing a developer supply container with a handle 12 which can be laid down into the recess of the developer supply container makes it possible to reduce the external measurement by laying down the handle 12, making it therefore possible to reduce the size of the packaging box for the developer supply container. Therefore, not only is it possible to reduce the cost of the packaging box, but also it is possible to reduce the space required for each developer supply container package, reducing thereby the shipment cost. Further, the handle 12 in this embodiment can be laid into the recess of a developer supply container in such a manner that when the handle 12 is in the laid down position, no part of the handle 12 protrudes from the external contour of the developer supply container, eliminating the problems that the handle 12 breaks, cracks, turns white across the portions subjected to stress, etc., during shipment.

Figure 19:
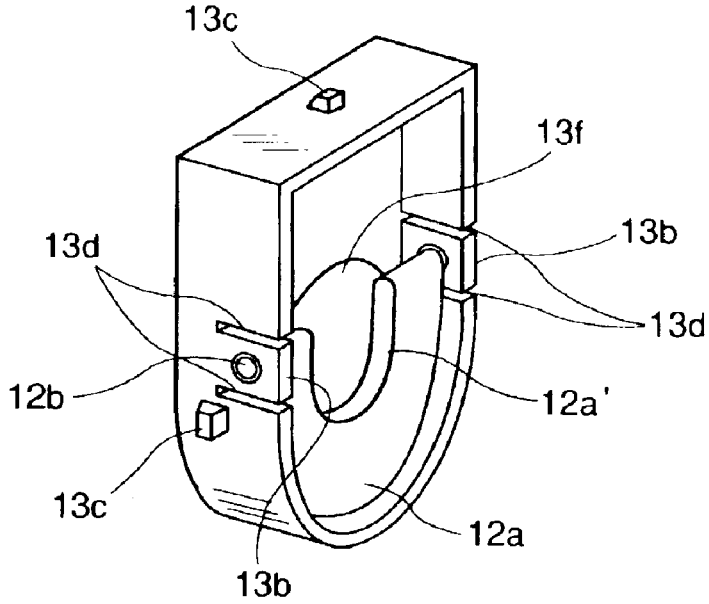
FIG. 19 is a perspective view of one of the modifications of the handle unit in the third embodiment of the present invention.
Figure 20:
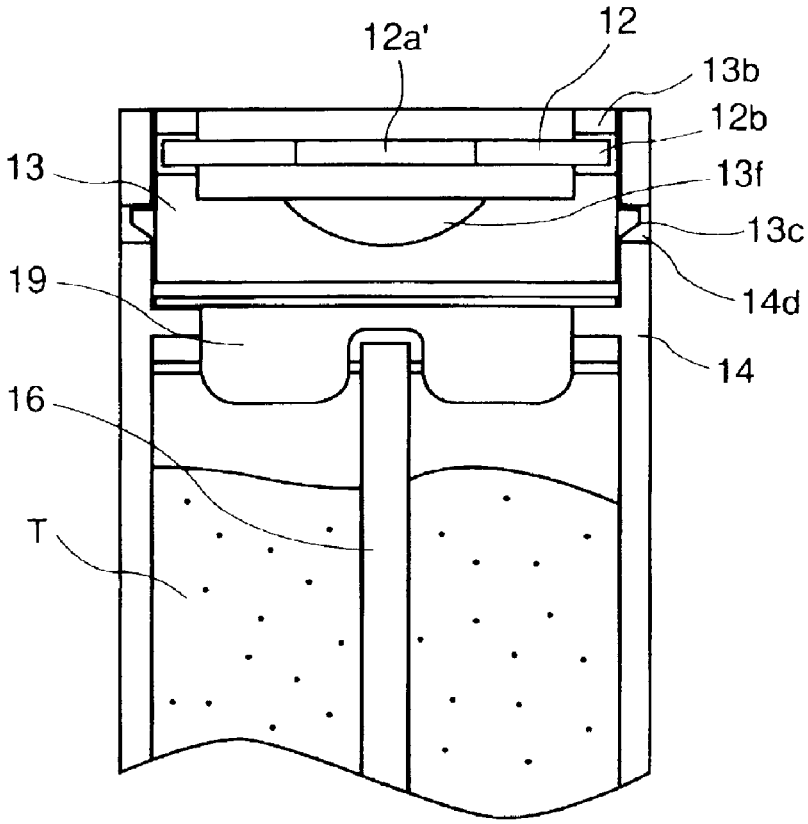
FIG. 20 is a sectional view of the handle portion of one of the modifications of the developer supply container A in the third embodiment.

Next, referring to FIG. 19, another modification of this embodiment will be described. In this modification, a part 12*a'* of the grip portion 12*a* of the handle 12, and a part 13*f* of the handle mount 13 have been cut out. With the provision of this structural arrangement, a user can put his or her finger into the space created by the removal of the above-described parts 12*a'* and 13*f*. Therefore, when a user wants to raise the handle 12 laid in the recess of the developer supply container A, the user can easily raise the handle 12 with the use of this hole. FIG. 20 shows another modification of this embodiment. In this modification, a developer inlet cap 19 for sealing the developer supply container A after the filling of the developer supply container A with developer is disposed on the inward side of the handle mount 13, as shown in FIG. 20. In order to reduce the size of developer supply container A, it is necessary to reduce the dimensions of the developer inlet cap 19, the handle mount 13, and the handle 12, in terms of the lengthwise direction of the developer supply container A in FIG. 20. However, reducing the above-described dimension of the handle 12, that is, the thickness of the handle 12, makes it difficult for a user to grasp the handle 12. Therefore, the part 12*a'* of the handle 12, and part 13*f* of the handle mount 13, have been cut out to provide a space in which a user can put his or her finger through to hook the handle 12 with the finger to raise the handle 12.

Figure 21:
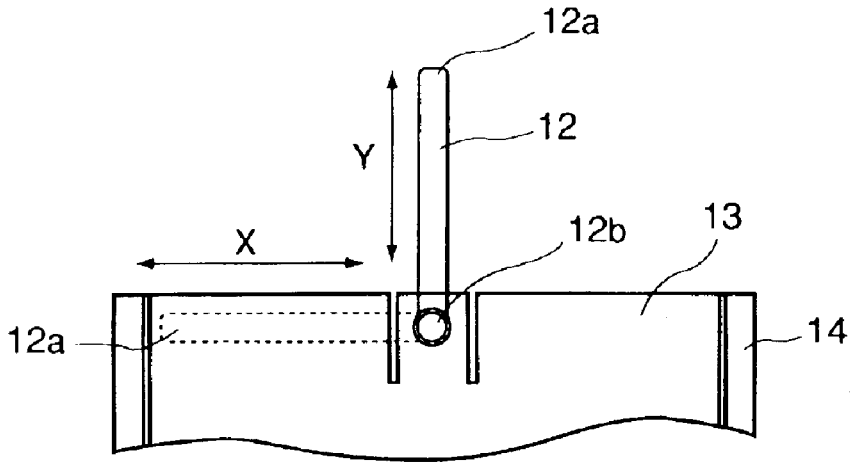
FIG. 21 is a sectional view of the handle portion of one of the modifications of the developer supply container A in the third embodiment, showing the structure thereof.

Referring to FIG. 21, when the angle of the handle laid down in the recess of the developer supply container A so that no part of the container A protrudes beyond the external contour of the container A is designated as 90 degrees (a direction roughly perpendicular to the direction in which container A is mounted; a direction indicated by arrow mark X in FIG. 21), and the angle of the handle in the upright position is designated as zero degree (a direction parallel to direction in which container A is mounted; a direction indicated by arrow mark Y in FIG. 21), the range in which the handle 12 is rotatable about the axial line of the connective portions 12*b* (connective holes of connective portions 13*b* ) is desired to be 90 from the upright position, or the zero degree position, of the handle 12 relative to the surface from which it projects.

The structures of the handle 12 and handle mount 13 are desired to be such that after the handle 12 is raised to the upright position, that is, after the angle of the handle 12 relative to the direction in which the developer supply container is reduced to is 0, the handle 12 is lightly locked and cannot be rotated any further. The provision of such a structural arrangement enables a user to tell whether or not the handle has been rotated enough, and also, prevents the handle 12 from feeling wobbly while the user is handling the developer supply container by grasping the handle 12.

Further, the structures of the handle 12 and handle mount 13 are desired to be such that when the handle 12 is in the recess of the developer supply container A, the angle of the handle 12 relative to the direction in which the developer supply container is mounted is 90, in other words, the handle 12 is parallel to the external contour of the container proper 14 as shown in FIG. 21. If the above described angle of the handle 12 is smaller than 90, a part of the handle 12 protrudes beyond the external contour of the container proper 14, reducing thereby the amount by which the size of the developer supply container can be reduced. In comparison, if the above described angle of the handle 12 is greater than 90, the grip portion 12*a* of the handle 12 will be more inward of the container proper 14, and the angle by which a user must rotate the handle 12 is greater, negatively affecting the operational efficiency, and also, making it necessary to provide the inward side of the container proper 14 with the space for the grip portion 12*a*. As a result, the amount by which the size of a developer supply container can be reduced is reduced. For the reasons described above, the combination of the handle 12 and handle mount 13 is desired to be structured so that when the handle 12 is in the laid position, the angle of the handle 12 relative to the direction in which the developer supply container is mounted is 90, in other words, the handle 12 is parallel to the external contour of the developer supply container, since such a structural arrangement is advantageous for the reduction of the size of a developer supply container.

When developer was supplied using the developer supply container A in this embodiment, the developer supplying operation could be carried out as easily, smoothly, and reliably as when the developer supply container A in the first or second embodiment was used. In addition, the employment of the handle 12 in this embodiment made it possible to reduce the length of the developer supply container A roughly 10%, and also, reduce the width of the apparatus main assembly. Further, it made it possible to reduce the size of a packaging box for the developer supply container A. Therefore, not only was it possible to reduce the cost of the packaging box, but also it was possible to reduce the space required for each developer supply container package, reducing thereby the shipment cost. Further, the developer supply container A in this embodiment was subjected to drop tests. In the tests, the handle 12 in this embodiment did not suffer from the problem of breakage; it did not break, crack, turn white across the portions subjected to stress, etc. Therefore, the packaging materials could be simplified, making it possible to further reduce the overall cost of the developer supply container A.

(Embodiment 4)

Figure 22:
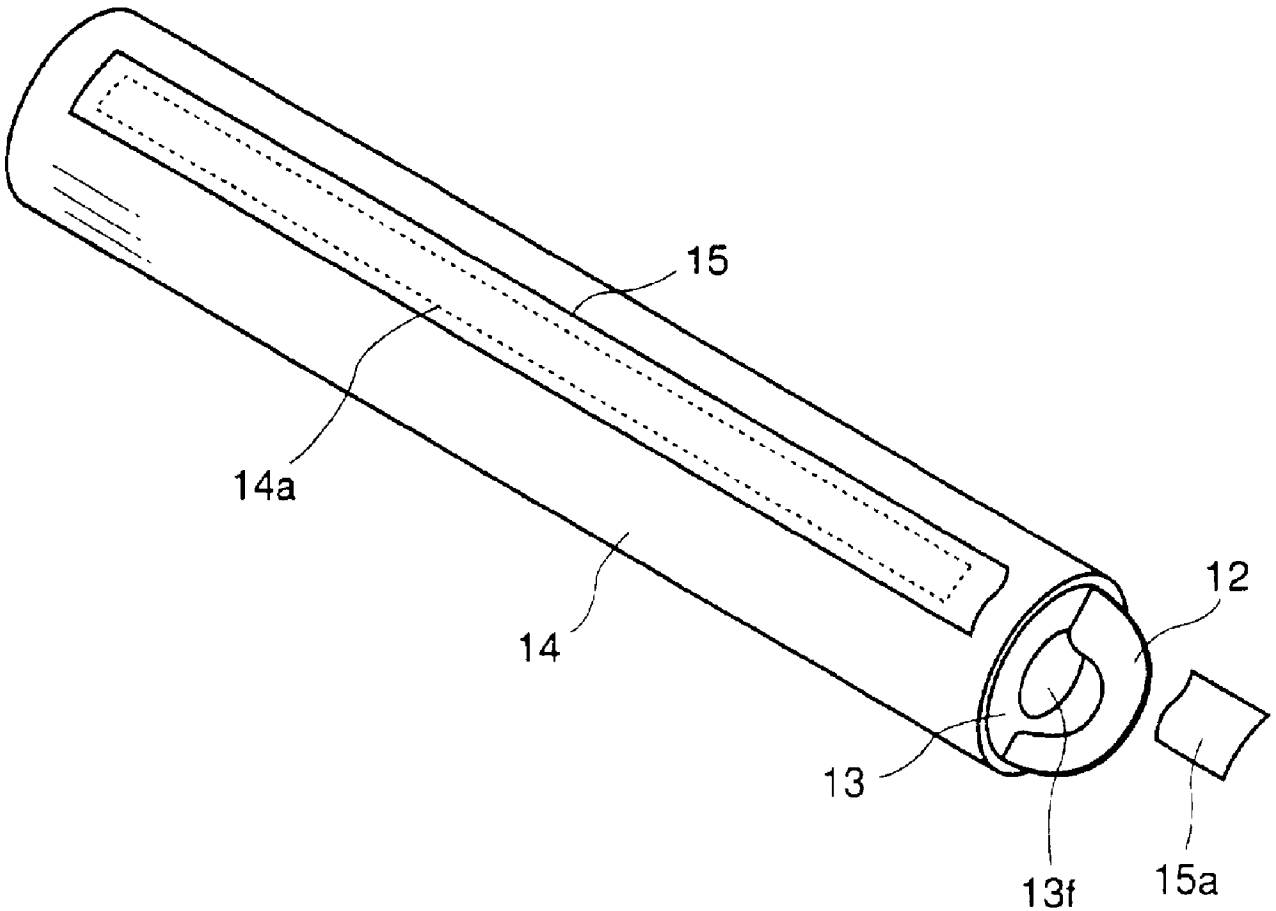
FIG. 22 is a perspective view of the developer supply container A in the fourth embodiment of the present invention, showing the structure thereof.

Next, referring to FIG. 22, the developer supply container in the fourth embodiment of the present invention will be described. The container proper 14 of the developer supply container in this embodiment is cylindrical, and is structured so that after the mounting of the developer supply container into the apparatus main assembly, the handle 12 can be grasped to rotate the developer supply container in order to align the opening of the developer outlet 14*a* with the opening of the developer inlet 5*f* of the developing apparatus 5. Otherwise, the developer supply container in the fourth embodiment is identical to that in the third embodiment. The container proper 14 of the developer supply container is 60 mm and 600 cc in diameter and internal volume, respectively, and is filled with 300 g of developer.

Also in this embodiment, the connective portions of the handle 12, and the connective portions of the handle mount 13, are in the form of a round shaft and a round hole, respectively, as are those in the third embodiment. Therefore, the handle 12 is rotatable about the axial line of the connective portions (shafts) of the handle 12. Since the container proper 14 of the developer supply container is cylindrical, the handle mount 13 is made circular in external contour, and the grip portion 12*a* of the handle 12 is made semicircular. Further, a semicircular piece has been cut out from the center side of the semicircular grip portion 12*a*. The method for assembling the handle unit in this embodiment is the same as that in the third embodiment.

Next, the developer-supplying operation carried out with the use of the developer supply container A in this embodiment will be described.

Just as in the developer-supplying operation carried out with the use of the developer supply container A in the third embodiment, a user is to take the developer supply container A out of the box in which the developer supply container A has been packed, and to mount the developer supply container A into the apparatus main assembly by grasping the handle 12. While the developer supply container A is mounted into the apparatus main assembly, the opening of the developer outlet 14*a* of the container proper 14 faces roughly upward, and the raised grip portion 12*a* of the handle 12 points roughly in the horizontal direction.

After the mounting of the developer supply container A into the apparatus main assembly, the user is to unseal the container proper 14 by pulling the developer seal 15, rotate the container proper 14 by grasping the handle 12, and align the opening of the developer outlet 14*a* of the container proper 14 with the opening of the developer inlet 5*f* of the developing apparatus 5, making it possible for the developer to be supplied to the developing apparatus 5. Lastly, the user is to rotationally lay the handle 12 into the recess of the container proper 14, finishing the developer-supplying operation. What occurs to the developer supply container A thereafter is the same as what occurs to the developer supply container A in the first embodiment; the stirring member 16 receives a driving force from the apparatus main assembly, being thereby rotated, and the stirring sheet 17 conveys the developer in the container proper 14 toward the developing apparatus 5.

After the completion of the developer-supplying operation, that is, after the depletion of the developer in the container proper 14, the user is to open the hinged cover 18 of the apparatus main assembly, raise the handle 12, grasp the handle 12, rotate the container proper 14 in the direction opposite to the direction in which the container proper 14 was rotated after it was mounted into the apparatus main assembly, and remove the developer supply container from the apparatus main assembly by pulling the handle 12 in the direction opposite to the direction in which the developer supply container was pushed into the apparatus main assembly. Then, the user is to mount a new developer supply container into the apparatus main assembly.

According to this embodiment, the developer supply container is mounted into the apparatus main assembly, with the opening of the developer outlet 14*a* of the container proper 14 facing upward, and then, the developer outlet 14*a* is unsealed, with the opening of the developer outlet 14*a* facing upward. Therefore, when the developer seal 15*a* is pulled to unseal the developer outlet 14*a,* virtually no developer is in the adjacencies of the opening of the developer outlet 14*a,* almost completely eliminating the possibility that contamination will occur due to the scattering of the developer from the developer outlet 14*a* as the developer seal 15*a* is removed. Further, when replacing the developer supply container, the developer supply container is pulled out of the apparatus main assembly, with the opening of the developer outlet 14*a* facing upward, eliminating the possibility that the developer remaining in the container proper 14 will scatter.

Structures similar to the above-described structural arrangement have been adopted in the past. According to this embodiment, however, not only is the developer supply container made in accordance with the third embodiment, but also it is rotated after it is inserted into the apparatus main assembly. Therefore, during the mounting of the developer supply container into the apparatus main assembly, the handle 12 is subjected to torsional force. However, the deformation of the connective portions 13*b* of the handle mount 13 is regulated by the container proper 14 as in the second and third embodiments. Therefore, the handle 12 does become disengaged. In other words, the developer supply container in this embodiment operates in the desirable manner.

Further, this embodiment also makes it possible to reduce the size of the box used for packaging the developer supply container A.

Figure 23:
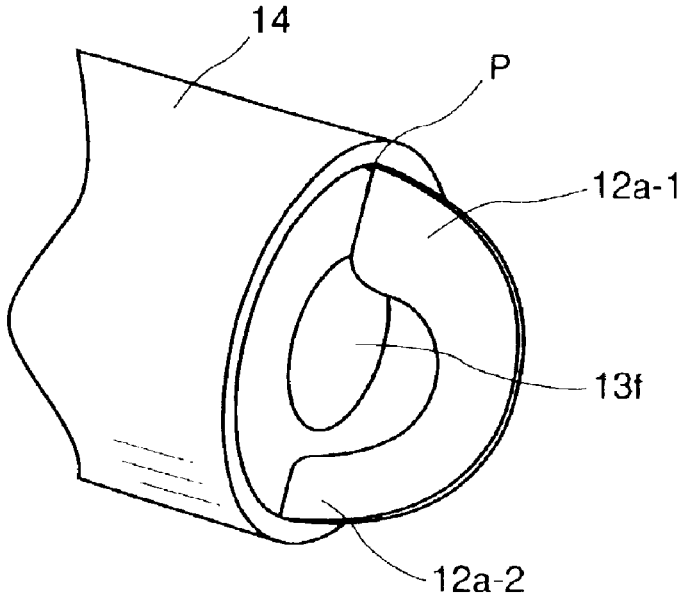
FIG. 23 is an enlarged perspective view of the handle portion of the developer supply container A in the fourth embodiment of the present invention, showing the structure thereof.

Referring to FIG. 23, the reference code 12*a* designates the grip portion of the handle 12, which is actually gripped by a user in order to rotate the developer supply container, as described above. Further, a reference code 12*a*-1 designates the portion of the grip portion 12*a* closest to a point P, that is, the topmost point of the handle 12 when the developer supply container has been mounted and is ready to be rotated, and a reference code 12*a*-2 designates the opposite end portion of the grip portion 12*a*. In order to make the grip portion 12*a* easier to grasp and rotate, the portion 12*a*-1 maybe made larger than the bottom portion 12*a*-2, for the following reason. That is, when a user rotates the developer supply container by grasping the grip portion 12*a,* the user normally grasps the portion 12*a*-1, or the top portion, with the thumb and index finger, and places the middle finger and the rest on the portion 12*a*-1, or the other end, to steady the handle 12. Thus, the top portion 12*a*-1 of the grip portion 12*a* is likely to be subjected to a larger amount of the finger force than the bottom portion 12*a*-2. Therefore, increasing the size of the top portion 12*a*-1 of the grip portion 12*a* increases the efficiency with which the finger force is transmitted to the grip portion 12*a,* increasing thereby operational efficiency.

(Comparative Example 1)

Figure 24:
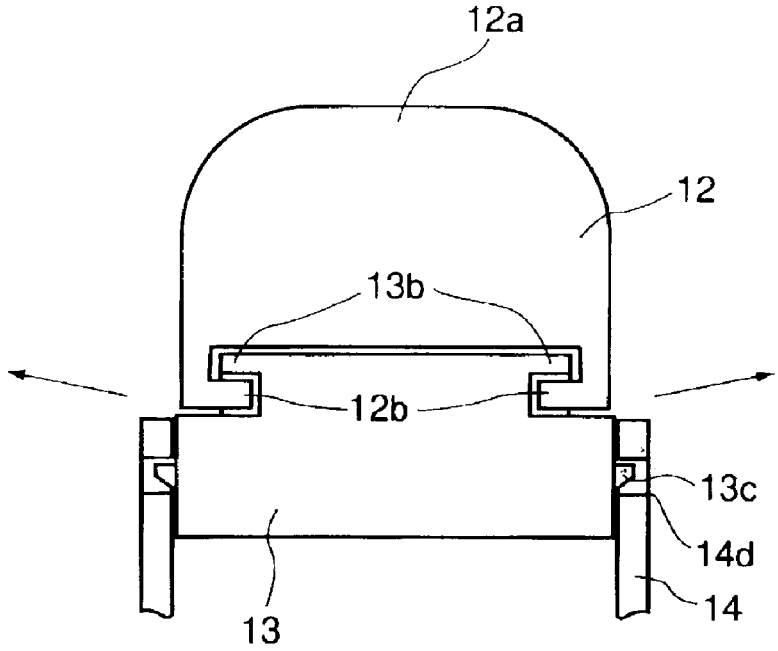
FIG. 24 is a sectional view of the handle portion of the first comparative example of the developer supply container.

Next, comparative examples of a developer supply container will be described. The first comparative example of a developer supply container was structured as shown in FIG. 24. This developer supply container was structured so that it was assembled as is the developer supply container in the first embodiment; in other words, the handle 12 was attached to the handle mount 13 by temporarily deforming the handle 12, and then, the handle mount 13 was attached to the container proper 14. In this comparative example, however, the connective portions 12*b* of the handle 12 were not regulated by the container proper 14. Otherwise, this comparative example was the same as the developer supply container in the first embodiment.

In this comparative example, the handle 12 was attached to the handle mount 13 by temporarily deforming the handle 12, but was not backed up by the container proper 14. Therefore, as a user pulled the handle 12, the connective portions 12*b* of the handle 12 deformed in the direction (indicated by an arrow mark in FIG. 24) to disengage from the connective portions 13*b* of the handle mount 13, actually disengaging sometimes.

In order to prevent this accident, a substance much higher in hardness and rigidity was used as the material for the handle 12. As a result, it became difficult to temporarily deform the handle 12 when attaching it to the handle mount 13. Therefore, a larger amount of force was necessary to attach the handle 12, and also, the connective portions 12*b* sometimes turned white, or cracked.

The comparative example is also similar in structure to the second embodiment. In other words, the handle 12 is attached to the handle mount 13 by temporarily deforming the connective portions 13*b* of the handle mount 13, and then, the handle mount 13 is attached to the container proper 14. In this comparative example, however, the connective portions 13*b* of the handle mount 13 are not regulated by the container proper 14. Therefore, as a user pulled the handle 12, the connective portions 13*b* of the handle mount 13 deformed, sometimes allowing the handle 12 to disengage from the connective portions 13*b* of the handle mount 13. Further, changing the material for the handle mount 13 resulted in the same problems as those described above.

(Comparative Example 2)

Figure 25:
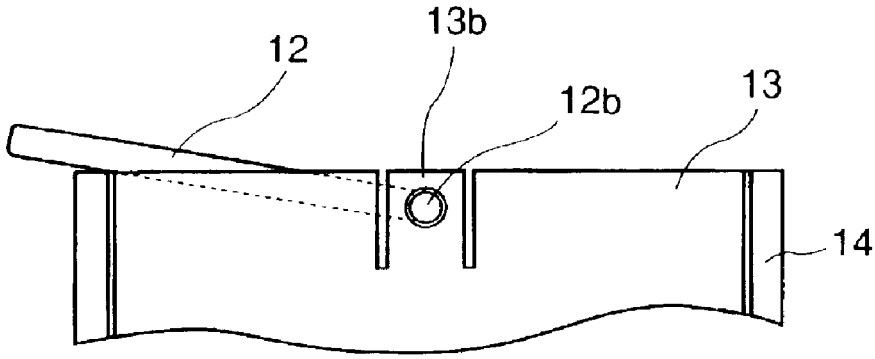
FIG. 25 is a sectional view of the handle portion of the second comparative example of the developer supply container.

Next, referring to FIG. 25, the second comparative example of a developer supply container will be described. This second comparative example was similar in structure to the third embodiment. In other words, the connective portions 12*a* of the handle 12 were in the form of a round shaft, and the connective portions 13*b* of the handle mount 13 were provided with a round hole. Therefore, the handle 12 was rotatably movable relative to the handle mount 13. In the case of this comparative example, however, the handle 12 and handle mount 13 were structured so that when the handle 12 was in the laid down position, a part of the handle 12 protrudes beyond the external contour of the developer supply container A; they are structured so that the handle 12 does not completely lay down into either the handle mount 13 or container proper 14.

Thus, the developer supply container A had to be mounted into the apparatus main assembly, or packaged, with the handle 12 protruding beyond the external contour of the developer supply container, requiring therefore a larger space for the developer supply container, which in turn added to the overall cost of this developer supply container.

Figure 26:
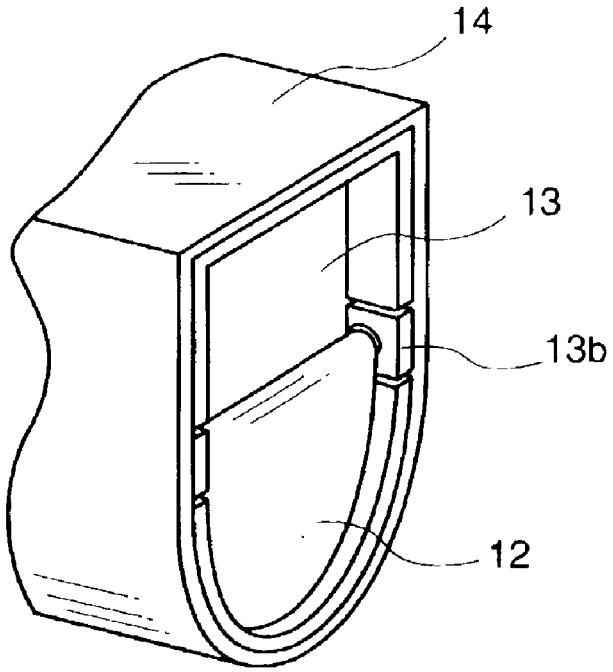
FIG. 26 is a perspective view of the handle portion of the second comparative example of the developer supply container, showing the structure thereof.

In comparison, when the structure of this second comparative example was modified so that the handle 12 did not protrudes beyond the external contour of the developer supply container A; the handle 12 could be laid into the handle mount 13 or the container proper 14; a part of the grip portion 12*a* of the handle 12 was not cut out, more concretely, the grip portion 12*a* of the handle 12 was made roughly semicircular as shown in FIG. 26; and the surface of the end wall of the container proper 14, onto which the grip portion 12*a* of the handle 12 is laid down, is made flat so that no gap is provided between the grip portion 12*a* and the above-described surface of the end wall, and the length of the developer supply container A could be minimized, but, no finger hole or the like, usable to raise the handle 12 to grasp it, was available, that is, the handle mount 13 was not provided with such a recess as the recess 13*f* of the developer supply container in the third embodiment, in which the user could insert his or her finger. Therefore, it was difficult for the user to grasp the handle 12 in the laid down position, reducing therefore operational efficiency sometimes.

As is evident from the above-described embodiments of the present invention, according to the present invention, not only is it possible to easily attach a handle to a developer supply container, but also it is possible to provide a simple structure capable of preventing the handle from disengaging from the developer supply container after the attachment of the handle to the developer supply container. In other words, according to the present invention, it is possible to provide a developer supply container which is smaller in component count and lower in cost, and yet, is capable of providing the above-described effects.

Further, according to the present invention, it is possible to reduce the size of a developer supply container. Therefore, it is possible to reduce the size of a box used for packaging a developer supply container, making it thereby possible to reduce the cost of a packaging box, and to increase the developer supply container shipment efficiency.

While the invention has been described with reference to the structures disclosed herein, it is not confined to the details set forth, and this application is intended to cover such modifications or changes as may come within the purposes of the improvements or the scope of the following claims.

What is claimed is:

1. A developer supply container detachably mountable to a developer receiving device, said developer supply container comprising:

a container body configured to contain a developer;

a grip member configured and positioned to grip said developer supply container; and an elastically deformable engaging member configured and positioned to engage said grip member, wherein said engaging member is mounted on said container body so that said container body limits elastic deformation of said engaging member in a direction of releasing the engagement of said grip member from said engaging member.

2. A container according to claim 1, wherein a part of said engaging member is disposed between said grip member and said container body.

3. A container according to claim 1, wherein said engaging member has a recess or through opening configured and positioned to rotatably support a shaft of said grip member.

4. A container according to claim 1, wherein said grip member is foldable so as not to be projected outwardly beyond an outside surface of said container body.

5. A container according to claim 1, wherein said grip member has a generally semi-circular shape, and wherein said engaging member is provided with a recess portion corresponding to an inside of the semi-circular shape of said grip member.

6. A container according to claim 1, wherein said engaging member is mounted on one longitudinal end surface of said container body.

7. A container according to claim 1, wherein said developer supply container is detachably mountable to an image forming apparatus when mounted on the developer receiving device.

8. A developer supply container detachably mountable to a developer receiving device, said developer supply container comprising:

a container body configured to contain a developer;

an elastically deformable grip member configured and positioned to grip said developer supply container; and an engaging member configured and positioned to engage said grip member, wherein said engaging member is mounted on said container body so that said container body limits elastic deformation of said grip member in a direction of releasing the engagement of said grip member from said engaging member.

9. A container according to claim 8, wherein a part of said grip member is disposed between said engaging member and said container body.

10. A container according to claim 8, wherein said engaging member has a recess or through opening configured and positioned to rotatably support a shaft of said grip member.

11. A container according to claim 8, wherein said grip member is foldable so as not to be projected outwardly beyond an outside surface of said container body.

12. A container according to claim 8, wherein said grip member has a generally semi-circular shape, and wherein said engaging member is provided with a recess portion corresponding to an inside of the semi-circular shape of said grip member.

13. A container according to claim 8, wherein said engaging member is mounted on one longitudinal end surface of said container body.

14. A container according to claim 8, wherein said developer supply container is detachably mountable to an image forming apparatus when mounted on the developer receiving device.

* * * * *

UNITED STATES PATENT AND TRADEMARK OFFICE

CERTIFICATE OF CORRECTION

PATENT NO. : 6,978,107 B2
APPLICATION NO. : 10/461464
DATED : December 20, 2005
INVENTOR(S) : Toshiaki Nagashima et al.

It is certified that error appears in the above-identified patent and that said Letters Patent is hereby corrected as shown below:

ON THE TITLE PAGE
Item 30, Foreign Application Priority Data, "2002/178083" should read --2002-178083--.

COLUMN 7
Line 15, "give" should read --given--.

COLUMN 8
Line 4, "100 m" should read --100 μm--.

COLUMN 9
Line 41, "hole 14d" should read --holes 14d--.

COLUMN 10
Line 32, "fitting" should read --fitted--.
Line 52, "inlet 15f" should read --inlet 5f--.

COLUMN 12
Line 4, "portions 14c," should read --portions 14e,--.

COLUMN 15
Line 13, "length of" should read --length of *l* --.
Line 41, "hole. FIG. 20" should read --hole. ¶FIG. 20--.

COLUMN 18
Line 45, "maybe" should read --may be--.

UNITED STATES PATENT AND TRADEMARK OFFICE

CERTIFICATE OF CORRECTION

PATENT NO. : 6,978,107 B2
APPLICATION NO. : 10/461464
DATED : December 20, 2005
INVENTOR(S) : Toshiaki Nagashima et al.

It is certified that error appears in the above-identified patent and that said Letters Patent is hereby corrected as shown below:

COLUMN 19
Line 57, "protrudes" should read --protrude--.

Signed and Sealed this

Fifteenth Day of August, 2006

JON W. DUDAS
*Director of the United States Patent and Trademark Office*